US006837789B2

(12) United States Patent
Garahi et al.

(10) Patent No.: US 6,837,789 B2
(45) Date of Patent: Jan. 4, 2005

(54) SYSTEMS AND METHODS FOR CROSS-PLATFORM ACCESS TO A WAGERING INTERFACE

(75) Inventors: Masood Garahi, Superior, CO (US); Connie T. Marshall, Muskogee, OK (US); William L. Thomas, Bixby, OK (US)

(73) Assignee: ODS Properties, Inc., Los Angeles, CA (US)

( * ) Notice: Subject to any disclaimer, the term of this patent is extended or adjusted under 35 U.S.C. 154(b) by 350 days.

(21) Appl. No.: 09/827,568

(22) Filed: Apr. 5, 2001

(65) Prior Publication Data

US 2001/0041612 A1 Nov. 15, 2001

Related U.S. Application Data

(60) Provisional application No. 60/194,910, filed on Apr. 5, 2000.

(51) Int. Cl.[7] ..... A63F 9/24
(52) U.S. Cl. ..... 463/29; 463/30
(58) Field of Search ..... 463/1, 6, 25, 29, 463/30, 31, 37, 40–43

(56) References Cited

U.S. PATENT DOCUMENTS

| | | | | |
|---|---|---|---|---|
| 3,909,002 | A | 9/1975 | Levy | 273/138 A |
| 4,033,588 | A | 7/1977 | Watts | 273/138 A |
| 4,108,361 | A | 8/1978 | Krause | 235/375 |
| 4,322,612 | A | 3/1982 | Lange | 235/419 |
| 4,339,798 | A | 7/1982 | Hedges et al. | 364/412 |
| 4,372,558 | A | 2/1983 | Shimamoto et al. | 273/238 |
| 4,494,197 | A | 1/1985 | Troy et al. | 364/412 |

(List continued on next page.)

FOREIGN PATENT DOCUMENTS

| | | | |
|---|---|---|---|
| EP | 0 387 046 A2 | 9/1990 | G07F/7/02 |
| EP | 0 583 196 A1 | 2/1994 | H04N/7/173 |
| EP | 0 620 688 A2 | 10/1994 | H04N/7/14 |
| EP | 0 624 039 A2 | 11/1994 | H04N/7/173 |
| EP | 0 673 004 A2 | 9/1995 | G07F/17/32 |
| EP | 0 873 772 A1 | 10/1998 | A63F/9/22 |
| EP | 0 934 765 A1 | 8/1999 | A63F/9/22 |
| GB | 2 300 535 A | 11/1996 | H04N/5/262 |
| JP | 01-25659 | 1/1989 | H04M/11/00 |
| JP | 01-269157 | 10/1989 | G06F/15/28 |
| JP | 02-110660 | 4/1990 | G06F/15/28 |
| JP | 02-231671 | 9/1990 | G06F/15/28 |
| JP | 06-325062 | 11/1994 | G06F/15/28 |
| WO | WO 95/01058 | 1/1995 | H04N/7/16 |
| WO | WO 95/30944 | 11/1995 | |
| WO | WO 97/19428 | 5/1997 | G07F/17/32 |
| WO | WO 00/77752 A2 | 12/2000 | G07F/17/00 |
| WO | WO 01/15450 | 3/2001 | |

OTHER PUBLICATIONS

US 5,823,877, 10/1998, Scagnelli et al. (withdrawn)
You Bet Help File, Youbet.com, Inc., Los Angeles, California, last modified Jul. 11, 1998, pp. 1–132.

(List continued on next page.)

*Primary Examiner*—Kim Nguyen
(74) *Attorney, Agent, or Firm*—Fish & Neave LLP; Evelyn C. Mak; Adam M. Saltzman

(57) ABSTRACT

Systems and methods for providing a consistent wagering interface to a variety of platforms are presented. A wagerer may access wagering information using a set-top box, computer, wireless device, or telephone. A central database can be used to store and maintain the wagerer's preferences for the wagering interface, personal history, account history, betting history, and default wagering selections. This information may be consistent across interfaces on all platforms or may be customized to each platform.

46 Claims, 32 Drawing Sheets

U.S. PATENT DOCUMENTS

| | | | | | |
|---|---|---|---|---|---|
| 4,593,904 | A | | 6/1986 | Graves | 273/1 E |
| 4,636,951 | A | | 1/1987 | Harlick | 364/412 |
| 4,652,998 | A | | 3/1987 | Koza et al. | 364/412 |
| 4,689,742 | A | | 8/1987 | Troy et al. | 364/412 |
| 4,694,490 | A | | 9/1987 | Harvey et al. | 380/234 |
| 4,704,725 | A | | 11/1987 | Harvey et al. | 380/9 |
| 4,706,121 | A | | 11/1987 | Young | 358/142 |
| 4,745,468 | A | | 5/1988 | Von Kohorn | 358/84 |
| 4,747,600 | A | | 5/1988 | Richardson | 273/269 |
| 4,760,527 | A | | 7/1988 | Sidley | 364/412 |
| 4,764,666 | A | | 8/1988 | Bergeron | 235/380 |
| 4,799,683 | A | | 1/1989 | Bruner, Jr. | 273/138 A |
| 4,815,741 | A | | 3/1989 | Small | 273/138 A |
| 4,882,473 | A | | 11/1989 | Bergeron et al. | 235/380 |
| 4,922,522 | A | | 5/1990 | Scanlon | 379/95 |
| 4,926,255 | A | | 5/1990 | Von Kohorn | 358/84 |
| 4,926,327 | A | | 5/1990 | Sidley | 364/412 |
| 4,965,825 | A | | 10/1990 | Harvey et al. | 380/233 |
| 4,969,183 | A | | 11/1990 | Reese | 379/88 |
| 4,996,705 | A | | 2/1991 | Entenmann et al. | 379/91 |
| 5,007,649 | A | | 4/1991 | Richardson | 273/237 |
| 5,034,807 | A | | 7/1991 | Von Kohorn | 358/84 |
| 5,054,787 | A | | 10/1991 | Richardson | 273/369 |
| 5,057,915 | A | | 10/1991 | Von Kohorn | 358/84 |
| 5,083,271 | A | | 1/1992 | Thacher et al. | 364/411 |
| 5,083,272 | A | | 1/1992 | Walker et al. | 364/412 |
| 5,083,800 | A | | 1/1992 | Lockton | 273/439 |
| 5,096,195 | A | | 3/1992 | Gimmon | 273/138 |
| 5,096,202 | A | | 3/1992 | Hesland | 273/237 |
| 5,112,050 | A | | 5/1992 | Koza et al. | 273/139 |
| 5,119,295 | A | | 6/1992 | Kapur | 364/412 |
| 5,178,389 | A | | 1/1993 | Bentley et al. | 273/138 |
| 5,186,471 | A | | 2/1993 | Vancraeynest | 273/439 |
| 5,218,631 | A | | 6/1993 | Katz | 463/41 |
| 5,227,874 | A | | 7/1993 | Von Kohorn | 358/84 |
| 5,233,654 | A | | 8/1993 | Harvey et al. | 380/20 |
| 5,249,044 | A | | 9/1993 | Von Kohorn | 358/86 |
| 5,276,312 | A | | 1/1994 | McCarthy | 235/380 |
| 5,280,426 | A | | 1/1994 | Edmonds | 364/408 |
| 5,282,620 | A | | 2/1994 | Keesee | 273/138 |
| 5,283,734 | A | | 2/1994 | Von Kohorn | 364/412 |
| 5,286,023 | A | | 2/1994 | Wood | 273/138 |
| 5,297,802 | A | | 3/1994 | Pocock et al. | 273/439 |
| 5,326,104 | A | | 7/1994 | Pease et al. | 273/138 |
| 5,327,485 | A | | 7/1994 | Leaden | 379/95 |
| 5,333,868 | A | | 8/1994 | Goldfarb | 273/138 |
| 5,340,119 | A | | 8/1994 | Goldfarb | 273/439 |
| 5,351,970 | A | | 10/1994 | Fioretti | 273/439 |
| 5,354,069 | A | | 10/1994 | Guttman et al. | 273/439 |
| 5,365,575 | A | | 11/1994 | Katz | 379/92 |
| 5,398,932 | A | | 3/1995 | Eberhardt et al. | 273/138 |
| 5,403,999 | A | | 4/1995 | Entenmann et al. | 235/379 |
| 5,408,417 | A | | 4/1995 | Wilder | 364/479 |
| 5,411,258 | A | * | 5/1995 | Wilson et al. | 463/6 |
| 5,415,416 | A | | 5/1995 | Scagnelli et al. | 273/439 |
| 5,417,424 | A | | 5/1995 | Snowden et al. | 273/138 |
| 5,505,449 | A | | 4/1996 | Eberhardt et al. | 273/138 |
| 5,507,489 | A | | 4/1996 | Reibel et al. | 273/138 |
| 5,518,253 | A | | 5/1996 | Pocock et al. | 273/439 |
| 5,539,450 | A | | 7/1996 | Handelman | 348/12 |
| 5,539,822 | A | | 7/1996 | Lett | 380/20 |
| 5,545,088 | A | | 8/1996 | Kravitz et al. | 463/40 |
| 5,564,977 | A | | 10/1996 | Algie | 463/25 |
| 5,569,083 | A | | 10/1996 | Fioretti | 463/19 |
| 5,573,244 | A | | 11/1996 | Mindes | 463/26 |
| 5,575,474 | A | | 11/1996 | Rossides | 463/26 |
| 5,577,727 | A | | 11/1996 | Brame et al. | 273/139 |
| 5,586,937 | A | | 12/1996 | Menashe | 463/41 |
| 5,608,785 | A | | 3/1997 | Kasday | 379/90 |
| 5,643,088 | A | | 7/1997 | Vaughn et al. | 463/40 |
| 5,647,795 | A | | 7/1997 | Stanton | 463/1 |
| 5,679,077 | A | | 10/1997 | Pocock et al. | 463/19 |
| 5,683,090 | A | | 11/1997 | Zeile et al. | 273/269 |
| 5,688,174 | A | | 11/1997 | Kennedy | 463/37 |
| 5,713,795 | A | | 2/1998 | Kohorn | 463/17 |
| 5,722,890 | A | | 3/1998 | Libby et al. | 463/17 |
| 5,729,212 | A | | 3/1998 | Martin | 340/870.28 |
| 5,746,657 | A | | 5/1998 | Ueno | 463/41 |
| 5,749,785 | A | | 5/1998 | Rossides | 463/25 |
| 5,755,621 | A | | 5/1998 | Marks et al. | 463/42 |
| 5,759,101 | A | | 6/1998 | Von Kohorn | 463/40 |
| 5,762,552 | A | | 6/1998 | Vuong et al. | 463/25 |
| 5,772,511 | A | | 6/1998 | Smeltzer | 463/17 |
| 5,787,156 | A | | 7/1998 | Katz | 379/93.13 |
| 5,800,268 | A | | 9/1998 | Molnick | 463/40 |
| 5,816,917 | A | | 10/1998 | Kelmer et al. | 463/16 |
| 5,816,919 | A | | 10/1998 | Scagnelli et al. | 463/25 |
| 5,823,872 | A | * | 10/1998 | Prather et al. | 463/6 |
| 5,823,879 | A | | 10/1998 | Goldberg et al. | 463/42 |
| 5,830,067 | A | | 11/1998 | Graves et al. | 463/40 |
| 5,830,068 | A | | 11/1998 | Brenner et al. | 463/42 |
| 5,830,069 | A | | 11/1998 | Soltesz et al. | 463/42 |
| 5,871,398 | A | | 2/1999 | Schneier et al. | 463/16 |
| 5,910,047 | A | | 6/1999 | Scagnelli et al. | 463/17 |
| 5,954,582 | A | | 9/1999 | Zach | 463/25 |
| 5,999,808 | A | | 12/1999 | LaDue | 455/412 |
| 6,001,016 | A | | 12/1999 | Walker et al. | 463/42 |
| 6,007,426 | A | | 12/1999 | Kelly et al. | 463/16 |
| 6,024,640 | A | | 2/2000 | Walker et al. | 463/17 |
| 6,024,641 | A | | 2/2000 | Sarno | 463/17 |
| 6,030,288 | A | | 2/2000 | Davis et al. | 463/29 |
| 6,080,062 | A | | 6/2000 | Olson | 463/42 |
| 6,080,063 | A | | 6/2000 | Khosla | 463/42 |
| 6,099,408 | A | | 8/2000 | Schneier et al. | 463/29 |
| 6,102,797 | A | | 8/2000 | Kail | 463/16 |
| 6,110,041 | A | * | 8/2000 | Walker et al. | 463/20 |
| 6,117,011 | A | | 9/2000 | Lvov | 463/25 |
| 6,117,013 | A | | 9/2000 | Eiba | 463/41 |
| 6,152,824 | A | | 11/2000 | Rothschild et al. | 463/42 |
| 6,186,892 | B1 | | 2/2001 | Frank et al. | 463/19 |
| 6,203,427 | B1 | | 3/2001 | Walker et al. | 463/16 |
| 6,251,016 | B1 | | 6/2001 | Tsuda et al. | 463/42 |
| 6,251,017 | B1 | | 6/2001 | Leason et al. | 463/42 |
| 6,254,480 | B1 | | 7/2001 | Zach | 463/17 |
| 6,257,982 | B1 | | 7/2001 | Rider et al. | 463/31 |
| 6,263,054 | B1 | | 7/2001 | Haefliger | 379/93.13 |
| 6,264,560 | B1 | | 7/2001 | Goldberg et al. | 463/42 |
| 6,272,223 | B1 | | 8/2001 | Carlson | 380/251 |
| 6,273,820 | B1 | | 8/2001 | Haste, III | 463/40 |
| 6,450,887 | B1 | * | 9/2002 | Mir et al. | 463/42 |
| 2001/0003099 | A1 | | 6/2001 | Von Kohrn | 463/40 |
| 2001/0003100 | A1 | | 6/2001 | Yacenda | 463/41 |

OTHER PUBLICATIONS

Maury Wolff, "Interactive Wagering A Good Bet," Daily Racing Form, Jan. 29, 1995, p. 4.

John Burgess, "And We're Off To The Races!" The Washington Post, Jan. 16, 1995, pp. 17–18.

Ross Peddicord, "New On TV: You Bet Your Horse," The Sun, Baltimore, Maryland, Dec. 15, 1994.

Yee–Hsiang Chang et al., "An Open–Systems Approach To Video On Demand," IEEE Communications Magazine, May, 1994, pp. 68–80.

TrackMaster User's Guide Version 2.0.7, Apr., 1994, AXCIS Pocket Information Network, Inc., Santa Clara, California, p. 1–122.

Kanichiro Yoshizawa et al., "Voice Response System for Telephone Betting," Hitachi Review vol. 26, No. 6, 1977, pp. 215–220.

Tiny Tim Brochure, AutoTote Systems Inc., Newark, Delaware (undated).

Probe XL Brochure, AutoTote Systems, Inc., Newark, Delaware (undated).

* cited by examiner

750

752

BETTING HISTORY

| DATE | 8/28/00 | 8/14/00 | 8/14/00 | 7/11/00 | 7/01/00 | 7/01/00 |
|---|---|---|---|---|---|---|
| TRACK: | AQU | AQU | OAK | TUR | AQU | AQU |
| RACE: | 1 | 1 | 2 | 3 | 2 | 3 |
| AMOUNT: | 20 | 100 | 100 | 50 | 50 | 25 |
| TYPE: | QUI | WIN | WIN | SHW | EXA | PK3 |
| HORSE(S): | | | | | | |
| 1ST | 2 | 3 | 5 | 1 | 4 | 5 |
| 2ND | 3 | — | — | — | 3 | 2 |
| 3RD | — | — | — | — | — | 4 |
| RESULTS: | | | | | | |
| 1ST | 3 | 1 | 4 | 2 | 4 | 5 |
| 2ND | 2 | 4 | 1 | 3 | 3 | 2 |
| 3RD | 5 | 2 | 3 | 6 | 1 | 4 |
| NET AMT: | +150 | -100 | -100 | -50 | +150 | +250 |

754

756

758

EXIT

762

760

*FIG. 19*

SYSTEMS AND METHODS FOR CROSS-PLATFORM ACCESS TO A WAGERING INTERFACE

CROSS REFERENCE TO RELATED APPLICATION

This application claims the benefit of U.S. provisional application No. 60/194,910, filed Apr. 5, 2000, which is hereby incorporated by reference herein in its entirety.

BACKGROUND OF THE INVENTION

This invention relates to wagering interfaces. More particularly, this invention relates to providing a consistent wagering interface on a variety of platforms.

Wagering is possible from different wagering platforms. A wagering platform may be any electronic device capable of transmitting and receiving wagering data (e.g., transmitting a wager or bet, receiving wagering-related information, etc.) to and from a wagering source. Wagering from telephones using an Interactive Voice Response (IVR) system has been available for several years. In recent years, wagering from television set-top boxes and personal computers has become increasingly popular. As technology advances, it is likely that wagering will also be possible from two-way data enabled cellular telephones (e.g., Wireless Application Protocol (WAP), Third Generation (3G), DoCoMo, and any other suitable technologies), pagers, handheld devices, and other suitable platforms.

A wagering interface may be an interactive display screen on a platform, from which a wagerer may view wagering data from the wagering source. In current wagering interfaces, multiple wagerers can access wagering information and place wagers from the same platform using different accounts and different user interfaces. Each wagerer can also use multiple platforms to access wagering information and place wagers.

However, there are limitations with existing wagering interfaces. Wagering preferences and default wagering selections on one interface from one platform may not be present on an interface from another platform. As a result, each time that a wagerer wants to set up a wager, the wagerer may have to change the betting mode, for example, from a novice mode to an expert mode, before making selections for each field. In addition, a wagerer may not be able to access his or her personal history, account history, or betting history information from every platform.

In view of the foregoing, it would be desirable to provide a consistent wagering interface for a variety of platforms.

SUMMARY OF THE INVENTION

It is an object of this invention to provide a consistent wagering interface for a variety of platforms.

The present invention provides a cross-platform access to a wagering interface. In a preferred embodiment of this invention, a central database is used to maintain a wagerer's preferences for each wagering interface, personal history, account history, and betting history information, and default wagering selections. This data may be accessed by various wagering platforms in order to present a consistent wagering interface to the wagerer.

A wagering interface that may be used in accordance with the present invention is illustrated in Marshall et al. U.S. patent application Ser. No. 09/330,651, filed Jun. 11, 1999, which is hereby incorporated by reference herein in its entirety. For example, an expert wagerer can select to have an advanced wagering interface (an interface tailored to the preferences of advanced wagerers) as the default interface whenever the wagerer places a wager. This default setting can be set from a set-top box platform. The systems and methods of the present invention may then preferably store that preference in a database accessible by other platforms. Upon the wagerer subsequently accessing the wagering interface from a personal computer (PC), the database is accessed to retrieve the same preference. Preferably, the PC interface is identical to the set-top box interface. Alternatively, the PC interface may retain only certain preferences in common with the set-top box interface, such as whether to default to the advanced interface or not. Additionally, the same preference can be applied to a two-way data enabled cellular telephone. Although the cellular telephone has a mini-browser that is not capable of providing the same interface as the PC, it nevertheless takes into consideration the same preference in providing its own interface.

Similarly, this invention enables a wagerer to check the status of his or her account or past wagers from multiple platforms by storing the information in a database accessible by each platform. This way, a wagerer can place a wager using his set-top box prior to going out for the evening, and while out, the wagerer can check the status of the wager using his or her two-way data enabled cellular telephone.

In accordance with this invention, a consistent wagering interface is provided for a variety of platforms.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIGS. 14–19 are illustrations of screen displays that may be presented as part of the wagering interface in a set-top box or personal computer in accordance with the present invention;

DETAILED DESCRIPTION OF THE INVENTION

Figure 1:
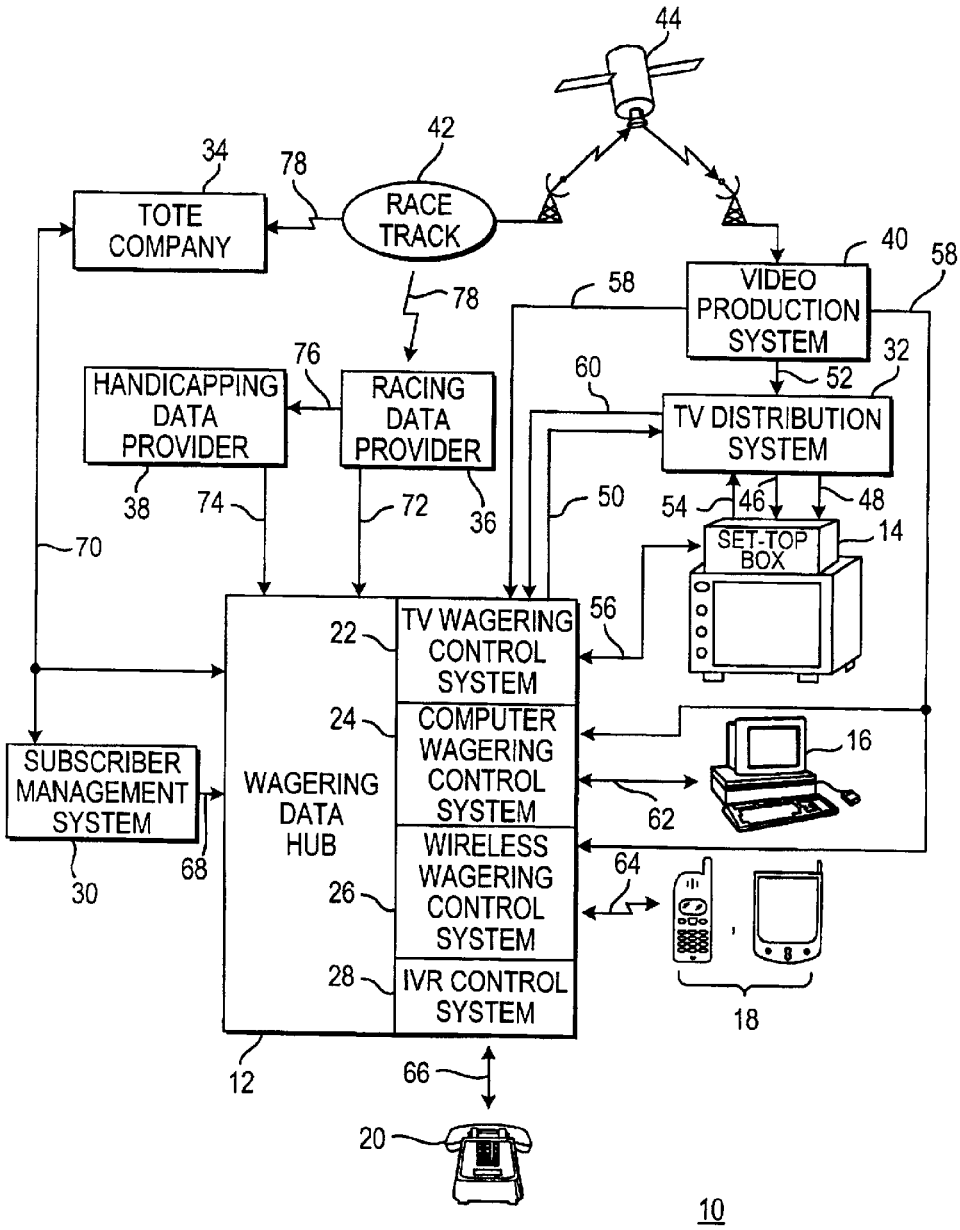
FIG. 1 is a block diagram of an interactive wagering system in accordance with one embodiment of the present invention.

FIG. 1 illustrates an interactive wagering system 10 in accordance with the present invention. Aspects of the invention apply to different types of wagering, but are primarily described herein in the context of interactive wagering on racing (e.g., horse racing) for specificity and clarity. As shown, system 10 includes a wagering data hub 12 that can control wagering in system 10 and that is coupled to television set-top box 14, user computer 16, wireless device (e.g., a two-way data enabled cellular telephone, a pager, a handheld device, a laptop computer, etc.) 18, and telephone 20. There may be more than one set-top box 14, computer 16, wireless device 18, and telephone 20, although only one of each has been shown to avoid over-complicating the drawing.

A wagerer of the present invention may receive information on wagering events and wagering accounts, and can place wagers related to those wagering events using set-top box 14, computer 16, wireless device 18, or telephone 20 coupled to hub 12. Each platform can receive wagering information from separate control systems in wagering data hub 12. For example, set-top box 14 can receive information from TV wagering control system 22, computer 16 can receive information from computer wagering control system 24, wireless device 18 can receive information from wireless wagering control system 26, and telephone 20 can receive information from interactive voice response (IVR) control system 28.

Wagering data hub 12 can also connect to subscriber management system 30, television distribution system 32, tote company 34, racing data provider 36, and handicapping data provider 38. There may be more than one television distribution system 32, tote company 34, racing data provider 36, and handicapping data provider 38, although only one of each has been shown to avoid over-complicating the drawing.

In accordance with the present invention, set-top box 14 may be any suitable device for receiving data signals and video signals, processing the data signals, displaying at least a portion of the data signals and the video signals, and receiving user commands that may cause data signals to be transmitted to wagering data hub 12. For example, set-top box 14 may be a conventional set-top box, may be circuitry in videocassette recorders, personal video recorders, digital video disc players, or televisions, or may be any other suitable device.

Set-top box 14 can receive data signals from hub 12 via communication link 50, television distribution system 32, and communication link 46. These data signals preferably include data relating to wagering events and wagering accounts. Alternatively or additionally to receiving the data signals via link 50, system 32, and link 46, these signals can be received directly via communication link 56.

Set-top box 14 can also receive video signals from video production system 40 via communication link 52, television distribution system 32, and communication link 48. These video signals preferably include video relating to wagering events that originate at race track 42 and are transmitted to video production system 40 via satellite 44. There may be more than one race track 42, although only one has been shown to avoid over-complicating the drawing. Alternatively or additionally to receiving video signals via link 52, distribution system 32, and link 48, video signals can be received from video production system 40 via communication link 58, hub 12, and link 56. Although links 46 and 48 are illustrated as separate paths for transmitting signals, each link may be part of a single communication mechanism (e.g., link 46 may transmit signals in the vertical blanking interval of a video signal carried in link 48).

Set-top box 14 can transmit wagering data signals to TV wagering control system 22 in wagering data hub 12 via communication link 54, television distribution system 32, and communication link 60, or directly via communication link 56. Communication link 56 may be a telephone connection, an Internet connection, a two-way wireless paging connection, or any other suitable connection. The signals received and transmitted by set-top box 14 may be any suitable type of analog signal, digital signal, or a combination of signals that are transmitted using any suitable method.

Television distribution system 32 and communication links 46, 48, 50, 52, 54, and 60 may all be part of a cable television system, a satellite television system, an over-the-air television system (including RF, microwave, etc.), a computer network (e.g., the Internet), a part of any suitable communication system, a combination of communication systems, or any other suitable system. Similar to links 46 and 48, link 54 may be incorporated with either link 46 or 48, or both as part of a single communication mechanism. Links 50 and 60 can also be incorporated together as part of a single communication mechanism if desired.

Computer 16 can connect to computer wagering control system 24 in hub 12 via computer network 62. Computer network 62 may be any suitable mechanism for connecting a computer to hub 12, such as a direct telephone connection, one or more telephone connections with a data network connection (such as an Internet connection or a connection provided by a computer network provider), or a direct data network connection.

Wireless device 18 can connect to wireless wagering control system 26 in hub 12 via wireless network 64. Wireless network 64 may be any suitable mechanism for connecting a two-way data enabled cellular telephone, a pager, a handheld device, a computer, etc. to hub 12, such as a satellite transmitter/receiver system or a data network connection (such as an Internet connection or a connection provided by wireless network provider). The two-way data enabled cellular telephone can include one of several technologies, including the Wireless Application Protocol (WAP), Third Generation (3G), DoCoMo, or any other suitable technologies.

Telephone 20 can connect to IVR control system 28 in hub 12 via telephone line 66, or using any other suitable mechanism. Although telephone 20 is illustrated as a standard telephone, any type of device for receiving audio prompts that allows a wagerer to respond to the audio prompts (either by spoken word or key depression) may also be used.

Subscriber management system (SMS) 30 may enable an operator of the present invention to control user access to the services provided by hub 12. In addition to being connected to hub 12 by communication link 68, SMS 30 can be connected to tote company 34 via communication link 70. Communication links 68 and 70 may be any suitable mechanism for communicating data and may use any type of data transmission method. The connection to tote company 34 may enable SMS 30 to create and update wagering accounts that may be located at tote company 34. For instance, when a wagerer places a wager using one of set-top box 14, computer 16, wireless device 18, or telephone 20, hub 12 can access SMS 30 to verify that the wagerer is authorized to wager or that the wager is valid.

Tote company 34, racing data provider 36, and handicapping data provider 38 may be connected to hub 12 via communication links 70, 72, and 74, respectively. Tote company 34 may provide wagering event data and wagering history or information to hub 12. Tote company may also receive wagering information from hub 12. Racing data provider 36 may provide statistical data and handicapping data provider 38 may provide handicapping data to hub 12. Tote company 34 and racing data provider 36 can receive data from race track 42 via communication link 78, while handicapping data provider 38 can receive data from racing data provider 36 via communication link 76. Data received from and transmitted to tote company 34, racing data provider 36, and handicapping data provider 38 can be transmitted over communication links 70, 72, and 74, respectively. Communication links 70, 72, 74, 76, and 78 may be any suitable mechanism for transmitting data using any suitable method.

Figure 2:
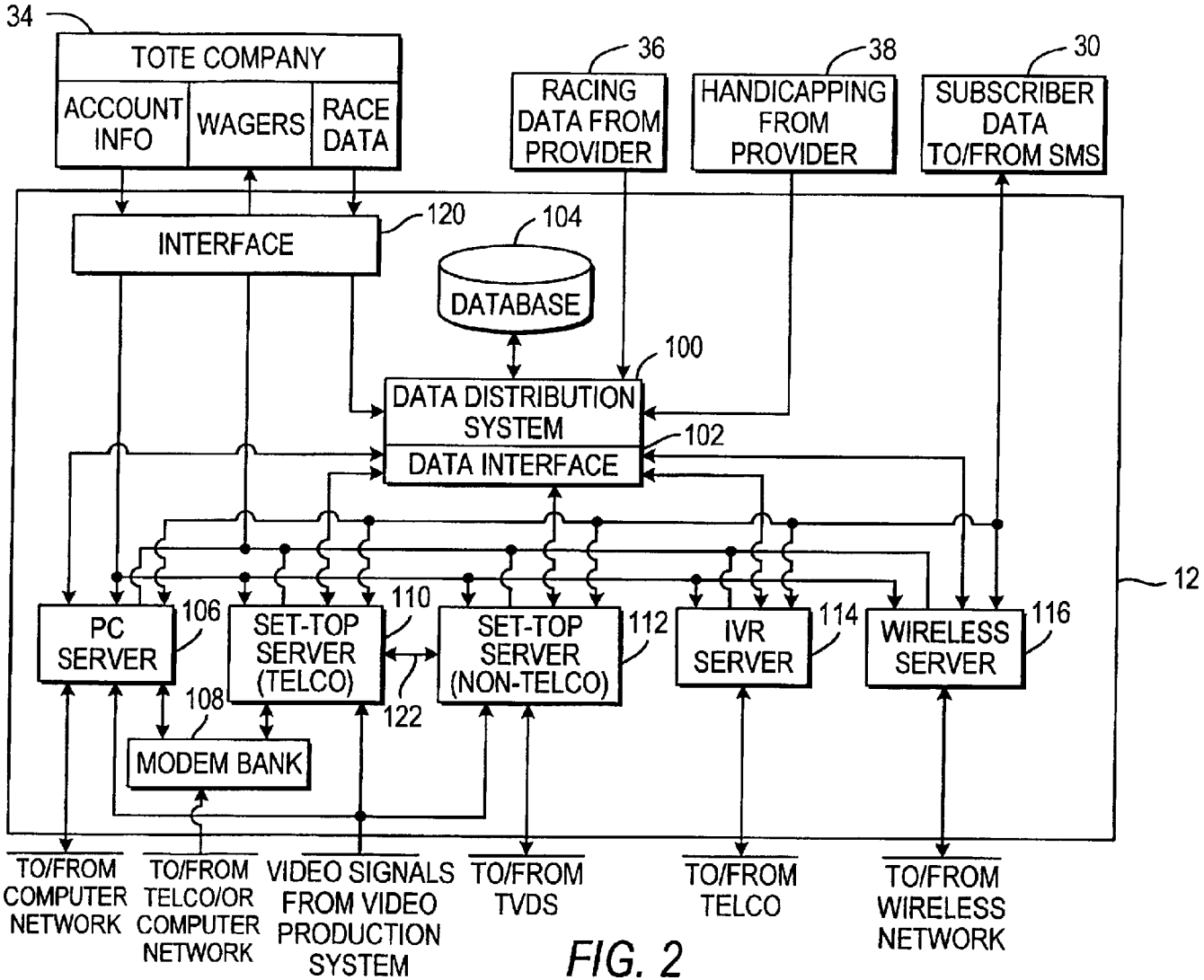
FIG. 2 is a block diagram of a subscriber management system suitable for use with the interactive wagering system of FIG. 1.

FIG. 2 illustrates a wagering data hub 12 suitable for use with interactive wagering system 10. Hub 12 can include data distribution system 100, data interface 102 (which may be part of or separate from data distribution system 100), database 104, set-top server (non-telephone company or non-telco) 112, set-top server (telephone company or telco) 110, personal computer (PC) server 106, modem bank 108, wireless server 116, interactive voice response (IVR) server 114, and interface circuitry 120. Data distribution system 100, data interface 102, and database 104 may work in conjunction with one other to receive, store, and provide racing, statistical, and handicapping data, among other components, in system 10 of the present invention. For example, data distribution system 100 can receive race data from either tote company 34 via interface circuitry 120, or from racing data provider 36. In addition, data distribution system 100 can receive handicapping data from handicapping data provider 38. This racing data and handicapping data can be provided to set-top servers 110 and 112, PC server 106, wireless server 116, and IVR server 114 via data interface 102.

Database 104 may be a central database used to store a wagerer's preferences, personal history, account history, and betting history information, and default wagering selections. Database 104 may also contain racing data, results, and any other suitable information. Data distribution system 100 may retrieve this information from database 104 and send the wagering information to data interface 102. Data interface 102 may convert the data into a form compatible with the selected platform (e.g., for display on set-top box 14, computer 16, or wireless device 18, or for an IVR form for telephone 20).

Set-top server (non-telco) 112 may provide data and video signals to, and receive data signals from, set-top box 14 via television distribution system 32. Set-top server (telco) 110 can provide data and video signals to, and receive data signals from, set-top box 14 via modem bank 108 and communication link 56. Set-top server (non-telco) 112, set-top server (telco) 110, and modem bank 108 may be part of TV wagering control system 22 in hub 12. Hub 12 can consolidate set-top servers 110 and 112 into a single mechanism, or can incorporate a link 122 between the set-top servers to coordinate data sent between them.

PC server 106 may provide data and video signals to, and receive data signals from, computer 16 via modem bank 108 and communication link 62, or directly via link 62. PC server 106 and modem bank 108 may be part of computer wagering control system 24 in hub 12. When computer 16 accesses PC server 106 via a telephone line, computer 16 may preferably use modem bank 108 and link 62. However, when computer 16 accesses PC server 106 via a computer network connection (such as the Internet through a cable line), computer 16 preferably bypasses modem bank 108, using only link 62.

Wireless server 116 may provide data and video signals to, and receive data signals from, wireless device 18 via communication link 64. Wireless server 116 may be part of wireless wagering control system 26 in hub 12. Wireless device 18 may be a laptop computer that uses a wireless local area network (LAN) to access wireless server 116. Wireless device 18 may also be a two-way data enabled cellular telephone that dials a modem attached to a dial-in server, which accesses wireless server 116.

Interactive voice response (IVR) server 114 may provide interactive voice prompts to telephone 20 via communication link 66. IVR server 114 may be part of IVR control system 28 in hub 12. These prompts may be a menu of actual or simulated voice options to which a wagerer can respond by speaking or depressing a button on telephone 20. IVR server 114 may provide account information, racing data, and handicapping data (including information about various races, horses, jockeys, odds, etc.) to a wagerer. IVR server 114 can also receive wagering data from the wagerer.

To authorize and submit wagers, each of servers 106, 110, 112, 114, and 116 preferably provides data to, and receives data from, tote company 34 via interface circuitry 120 and link 70, and from subscriber management system (SMS) 30 via link 68. For example, when a wagerer requests to place a wager via any of these servers, the corresponding server may send an authorization request to either SMS 30 or tote company 34. When the request is sent to tote company 34, the server may select the desired tote company from among several available tote companies. In response to the request, SMS 30 or tote company 34 may reply with an authorization and the server may then send the wager to the selected tote company 34. Similarly, account information may be transmitted to and received from SMS 30 or tote company 34 to notify a wagerer of the status or history of his or her account or to credit that account with additional funds or winnings. A wagerer may also authorize additional funds to be transferred from the wagerer's bank or credit card account when the available funds in the account fall below a desired level.

In an embodiment of the present invention, video signals are provided to set-top box 14 by set-top servers 110 and/or 112, to computer 16 by PC server 106, and to wireless device 18 by wireless server 116. These signals may be received at the corresponding servers from video production system 40 via communication link 58.

Figure 3:
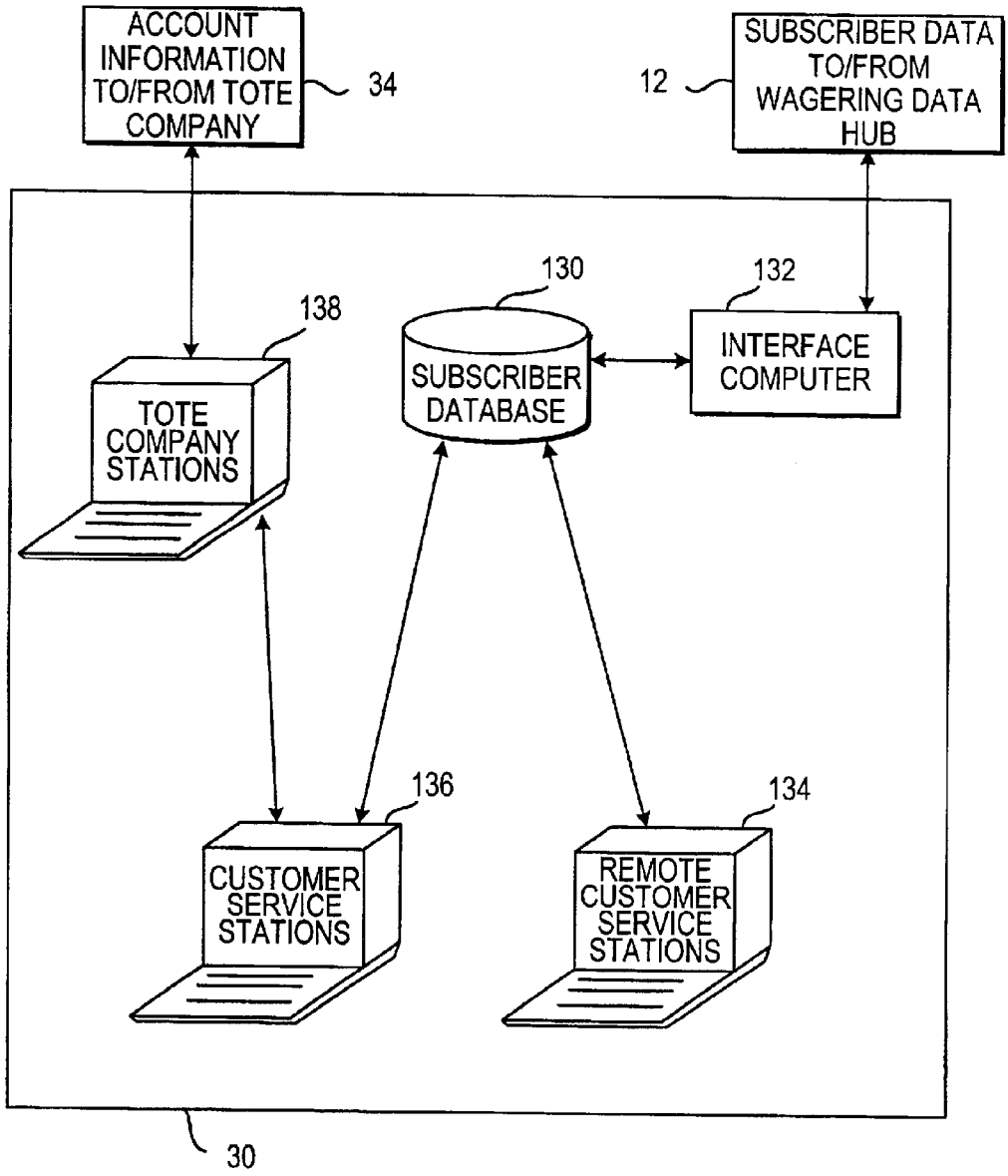
FIG. 3 is block diagram of a wagering data hub suitable for use with the interactive wagering system of FIG. 1.

One embodiment of subscriber management system (SMS) 30 in accordance with the present invention is illustrated in FIG. 3. SMS 30 can include subscriber database 130, interface computer 132, customer service station 136, remote customer service station 134, and tote company administration station 138. Only one customer service station 136, remote customer service station 134, and tote company administration station 138 has been show to avoid over-complicating the drawing. Subscriber database 130 may store information on each wagerer's account. This data may include current balance, past wagering history, individual wagering limit, personal identification number, billing address, credit card number, bank account number, social security number, personal pin number, and any other suitable information. Alternatively, this information may also be stored in database 104 of hub 12 (FIG. 2). The data in subscriber database 130 can be accessed by hub 12 using interface computer 132. In other embodiments of the present invention, interface computer 132 may be omitted and instead, hub 12 may directly access subscriber database 130.

Customer service stations 136 and 134 may enable an operator of wagering system 10 to monitor and control the usage of the system by wagerers. Tote company administration station 138 may enable the operator of system 10 to create and update accounts for wagerers at tote company 34. Subscriber database 130 may be any suitable device for storing data and interface computer 132 may be any suitable device for accessing the database. Each of stations 134, 136, and 138 may be any suitable computer for accessing subscriber database 130 and tote company 34.

Although wagering data hub 12 and subscriber management system 30 are illustrated as separate systems located at different facilities, they may be combined into a single system at a single location, or may be further split apart into sub-units at remotely connected locations.

As shown in FIGS. 1–3, the storage of racing data, handicapping data, and a wagerer's information is preferably contained in database 104 of hub 12 or in subscriber database 130 of SMS 30. This provides a more centralized interactive wagering system that can be accessed by wagerers using a variety of platforms. Regardless of the platform used, a wagerer may only need to access one database from any suitable platform in order to obtain personal history, account history, and betting history information, wagering preferences, and default wagering selections.

Figure 4:
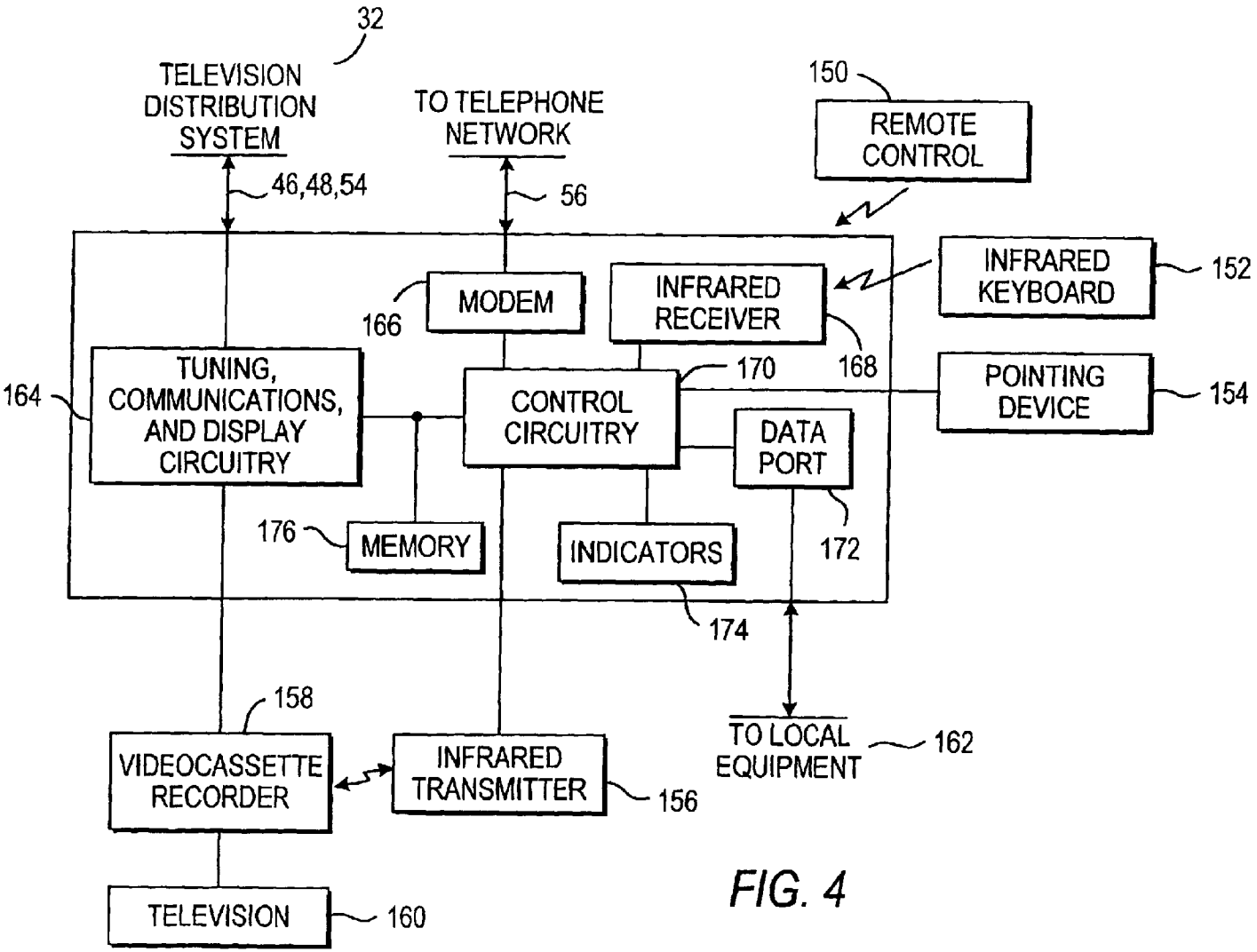
FIG. 4 is a block diagram of a set-top box and related equipment suitable for use with the interactive wagering system of FIG. 1.

FIG. 4 illustrates set-top box 14 and related components. Set-top box 14 can be connected to television distribution system 32 by communication links 46, 48, and 54. Set-top box 14 can also be connected to a telephone network via communication link 56. Set-top box 14 can communicate with wagering data hub 12 using these communication links. To control set-top box 14, remote control 150, keyboard 152 (e.g., an infrared keyboard), and/or pointing device 154 (e.g., a mouse) can also be provided. Additionally, set-top box 14 can be connected to any suitable television appliance (e.g., videocassette recorder 158, personal video recorder (PVR), digital video recorder (DVR), etc.) and/or television 160, and any other local equipment 162 (such as a personal computer) that may be connected to a cable modem in set-top box 14. Infrared transmitter 156 or any other suitable control interface (e.g., an RS-232 interface) may also be provided to control videocassette recorder 158.

Set-top box 14 can include the following components: tuning, communications, and display circuitry 164, modem 166, receiver 168 (e.g., an infrared receiver), control circuitry 170, data port 172, indicators 174, and memory 176. Tuning, communications, and display circuitry 164 may be any suitable circuitry for receiving, splitting, combining, and/or distributing video and data signals to and from television distribution system 32, control circuitry 170, memory 176, and videocassette recorder 158 and television 160. Modem 166 may be any suitable device for communicating data with telephone network 56. Receiver 168 may be any suitable device for receiving signals from keyboard 152. Control circuitry 170 may be any suitable device (e.g., microprocessor, microcontroller, dedicated logic, computer, etc.) for controlling the functionality of set-top box 14. Data port 172 may be any suitable interface for communicating with local equipment 162. Indicators 174 may be any suitable devices (e.g., light-emitting diodes, displays, audio systems, etc.), for signaling events and the status of events to a wagerer. Memory 176 may be any suitable storage device (e.g., random access memory, flash memory, a disk drive, etc.).

During operation, control circuitry 170 may execute instructions stored in memory 176. These instructions may control the flow of video and data through control circuitry 170, may control the flow of data through modem 166, receiver 168, data port 172, and infrared transmitter 156, and may drive indicators 174. More particularly, these instructions may implement the user interface display on television 160.

Figure 5:
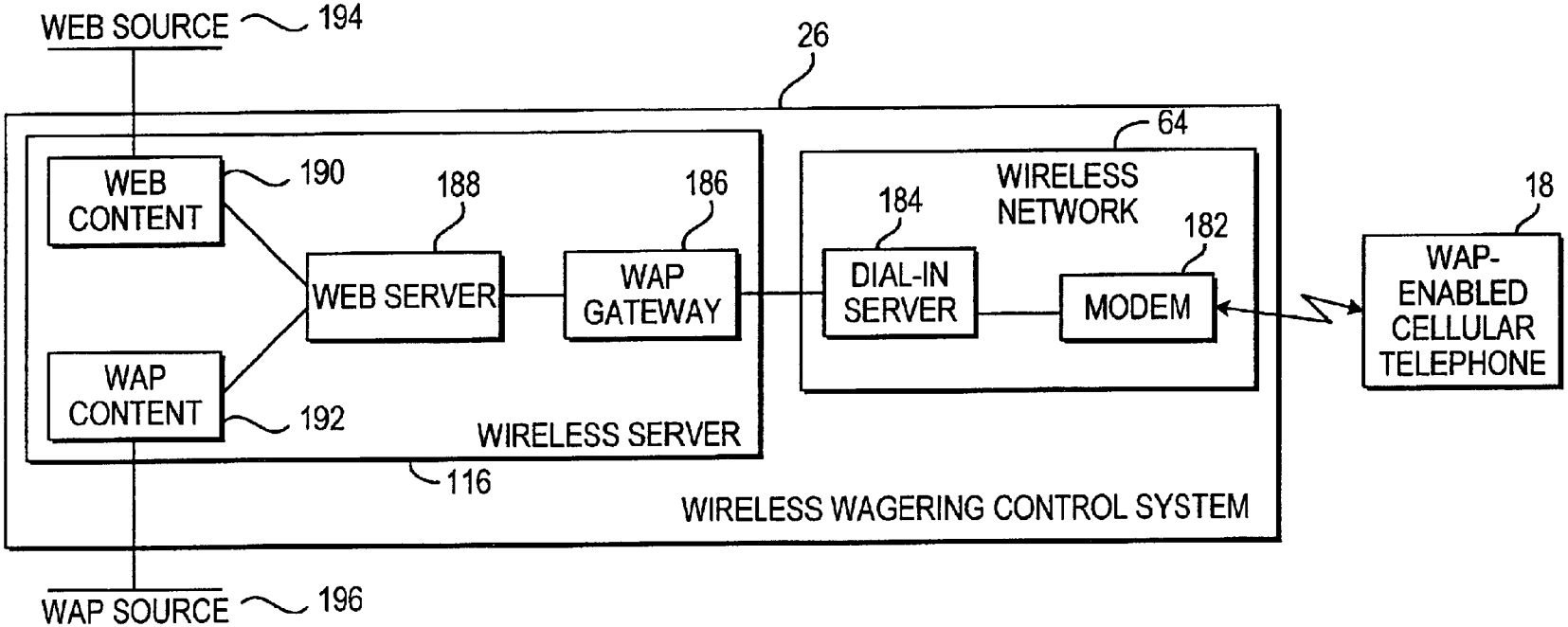
FIG. 5 is a block diagram of a wireless control system for use with the interactive wagering system of FIG. 1.

FIG. 5 illustrates components of a wireless wagering control system 26. Aspects of the wireless device apply to different types of two-way data enabled devices (e.g., WAP, 3G, DoCoMo enabled cellular telephones, pagers, handheld devices, laptops, etc.), but are primarily described herein in the context of the wireless application protocol enabled (WAP-enabled) cellular telephones for simplicity and clarity. A wagerer who wants to view wagering information on a WAP-enabled cellular telephone 18 can dial in to wireless network 64. Wireless network 64 can contain modem 182, which can be connected to dial-in server 184. Once a connection has been made, dial-in server 184 can communicate with wireless server 116. Wireless server 116 can contain WAP gateway 186, web server 188, web content 190, and WAP content 196.

WAP gateway 186 may link WAP device 18 with the web (e.g., World Wide Web, Internet). WAP gateway 186 may convert web data into a form readable by WAP-enabled cellular telephone 18. While web data may be readable as Hypertext Markup Language (HTML), WAP device 18 is capable of reading Wireless Markup Language (WML). Thus WAP gateway 186 may be responsible for converting web data (HTML) into WML. Since WAP device 18 may contain a mini-browser that can support minimal text and simplified graphics, the display may contain the same content but may be represented differently than on a computer or set-top box. The web data that is WML can then be transmitted and displayed on WAP device 18.

Web server 188 can contain data from both the web content 190 and WAP content 192. Once information is requested from WAP device 18, web server 188 may send the requested data to WAP device 18 via WAP gateway 186 and wireless network 64. Web content 190 may obtain data from the web or Internet sites in the form of HTML, while WAP content 192 may obtain data from WAP sites in the form of WML. Web content 190 and WAP content 192 can obtain data from sources 194 and 196, respectively. Data sources 194 and 196 may be from different sources or from the same source but in different languages (e.g., HTML, WML). Sources 194 and 196 may include data distribution system 100, tote company 34, racing data provider 36, handicapping data provider 38, subscriber management system 30, or any other data source. Data may be provided to web content 190 and WAP content 192 directly or indirectly (e.g., racing data may be provided to web content 190 via data distribution system 100).

A variety of user interfaces may be provided to set-top box 14, computer 16, wireless device 18, and telephone 20. An embodiment of a user interface that may be implemented at set-top box 14, computer 16, wireless device 18, and telephone 20 is illustrated in FIGS. 6–13 in accordance with the present invention. Although specific combinations of features are illustrated, any subset of these features and many additional features may be implemented. FIGS. 6–13 pertain mainly to horse racing, though the user interface may be modified to include any type of wagering event.

Figure 6:
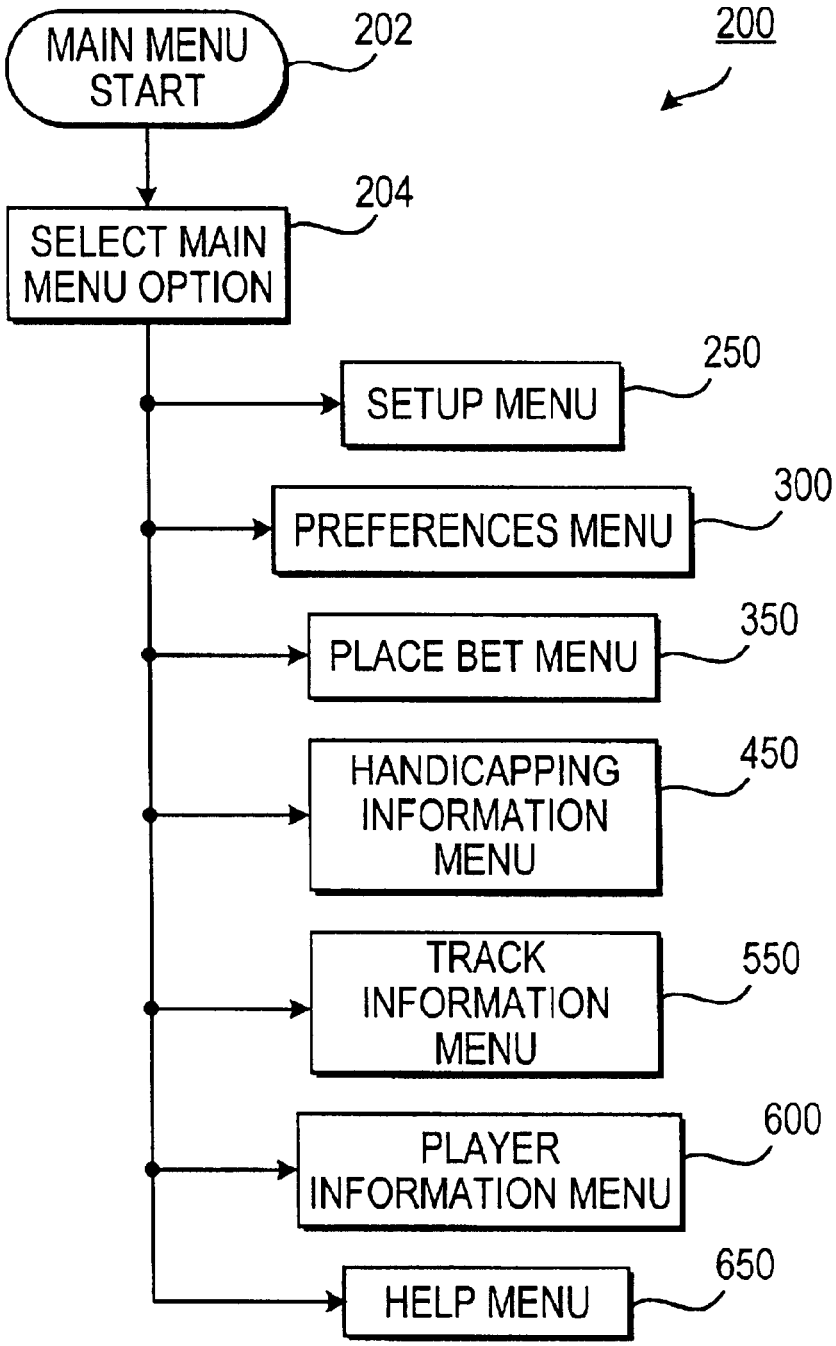
FIG. 6 is a diagram illustrating one embodiment of a main menu mode that may be presented in a set-top box, computer, wireless device, or telephone in accordance with the present invention.

FIG. 6 is a diagram illustrating wagering main menu mode 200. Prior to allowing a user to select from main menu options, there may be an initial login sequence at step 202. The login sequence permits only authorized wagerers to modify user profiles or to perform other actions associated with the wagering interface. Once a wagerer has correctly logged on, main menu options 204 can be displayed on a television screen, on a computer web browser, or on a two-way data enabled cellular telephone mini-browser, or can be voice automated over a telephone, or over any suitable display screen or voice system. Main menu options can include links to "Setup Menu" 250, "Preferences Menu" 300, "Place Bet Menu" 350, "Handicapping Information Menu" 450, "Track Information Menu" 550, "Player Information Menu" 600, and "Help Menu" 650. These options may appear in any order and can be rearranged or modified according to a wagerer's preferences.

Any of these options, or any of the options in the subsequent menus, may be selected using any of several devices. For set-top box 14, a wagerer may position a highlighted bar to surround a desired option using arrow keys or numeric keys on a device such as a remote control. For a web-enhanced television system or computer 16, a keyboard and/or mouse (wireless or non-wireless) can be used to select the options. For wireless device 18 (e.g., a two-way data enabled cellular telephone), arrow keys or alphanumeric keys may be used to select the options. For telephone 20 (e.g., touch-tone phone, cordless phone, cellular telephone), alphanumeric buttons may be used, or a wagerer may use his or her voice to select the options. Any other suitable method for selecting the menu options may also be used in accordance with the present invention.

Figure 7:
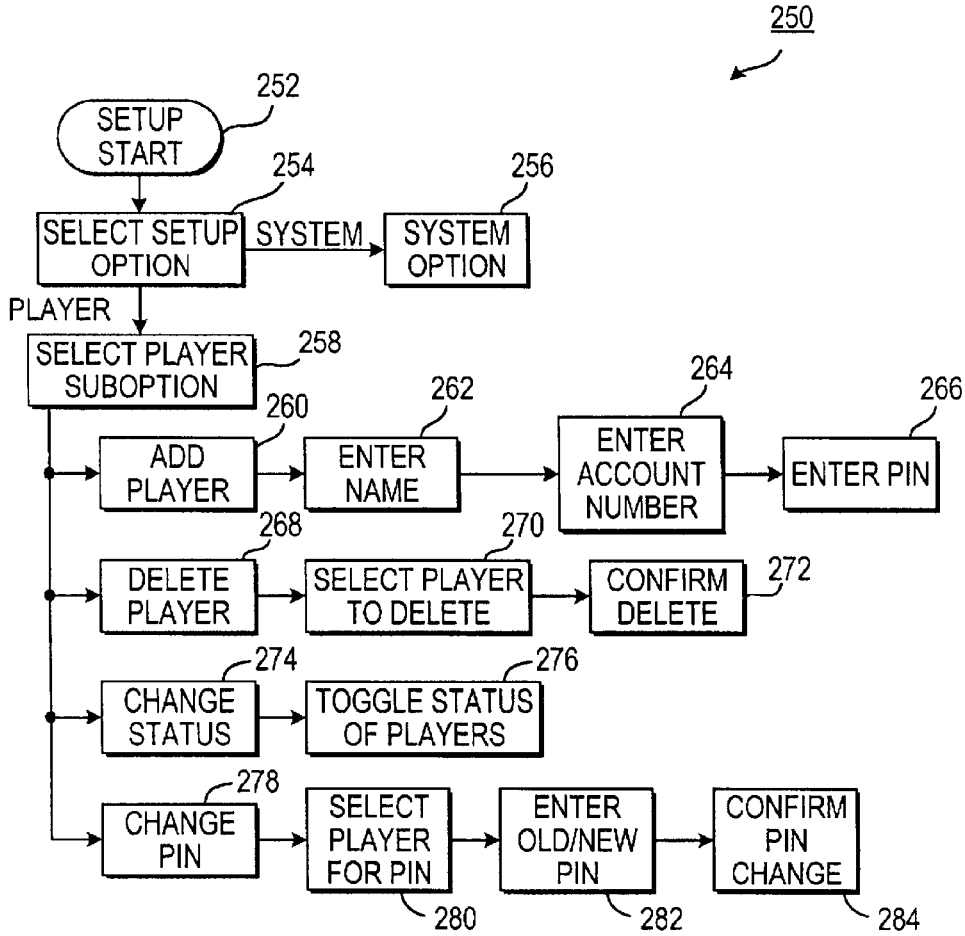
FIG. 7 is a diagram illustrating one embodiment of a setup mode in accordance with the main menu of FIG. 6.

FIG. 7 is a diagram illustrating wagering setup menu 250. A wagerer can select "Setup Menu" 250 from main menu 200 (FIG. 6) to access setup menu 252, which enables the wagerer to maintain player accounts and telephone settings for a selected user interface. The setup menu can contain the following options 254: "System" 256 and "Select Player" 258. "System" 256 may allow the wagerer to establish or edit telephone settings, which permits the wagerer to access and/or change wagering information and to send in wagers via a telephone line or any other suitable connection line. "Select Player" option 258 may allow the wagerer to establish or update player accounts.

Picking "Select Player" results in the following options: "Add Player" 260, "Delete Player" 268, "Change Status" 274, and "Change Pin" 278. "Add Player" option 260 allows the wagerer to enter the name of the player to be added 262, an account number 264, and a pin 266. The name can be a full name, first name, last name, nickname, or any other identifier that distinguishes the new player from the other wagerers using the same wagering platform. The account number may be a pre-assigned account number, a credit card number, or any other suitable number to identify the owner of the account. If the wagerer selects an account number in use by another player, the interface may prompt the user to enter in a different account number. The pin can be any combination of letters, numbers, or both. This pin is preferably entered twice to insure that it has been entered correctly.

"Delete Player" option 268 may allow the wagerer to delete a player from the particular user interface. The wagerer may select the player to be deleted 270 from a list of players using the same platform. The selected player will be deleted upon confirmation of the deletion 272. In a preferred embodiment of the present invention, only selected players may be authorized to delete player accounts. Whenever the wagerer attempts to delete a player account, the wagerer may be prompted to enter a pin that corresponds to the account of the person authorized to delete players from the wagering platform. Only one player, some, or all players may be authorized to delete the accounts. Alternatively, only a player may delete his or her own account.

"Change Status" option 274 may allow the wagerer to change the status of a player from "Active" to "Not Active," or vice versa. The wagerer can toggle the status of players 276 listed in the user interface by selecting the desired player's name.

"Change Pin" option 278 may allow the wagerer to change the wagerer's pin. First, the wagerer can select his or her account name 280. Next, the wagerer is prompted to enter the old pin followed by a new pin for the selected account 282. The pin change can be confirmed 284 by reentering the new pin.

Figure 8:
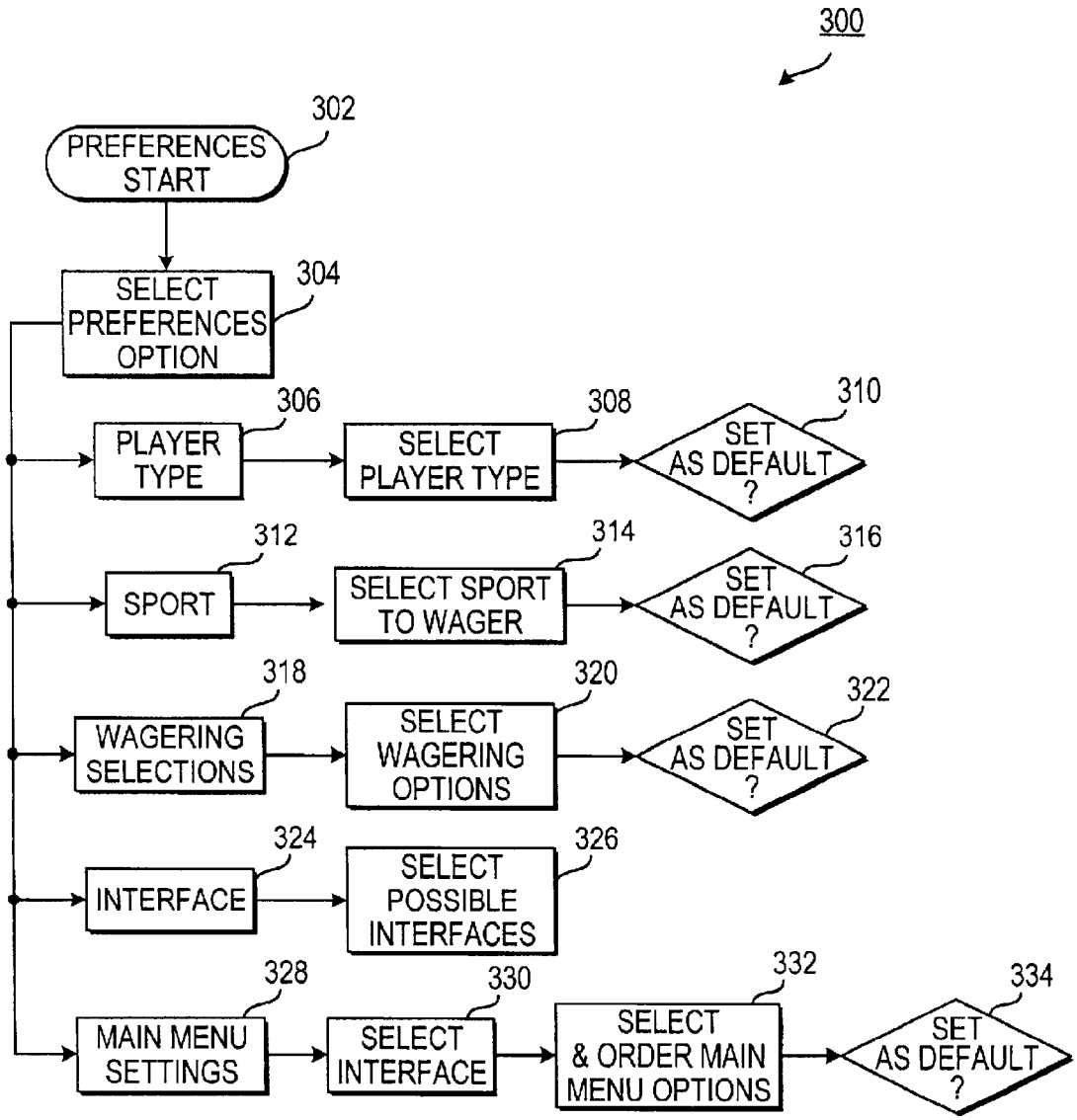
FIG. 8 is a diagram illustrating one embodiment of a preferences mode in accordance with the main menu of FIG. 6.

FIG. 8 is a diagram illustrating wagering preferences menu 300. The wagerer can select "Preferences Menu" 300 from main menu 200 (FIG. 6) to access preferences menu 302, which enables a wagerer to maintain player preferences, customize user interfaces, and set default wagering selections for each player for each wagering platform. Preferences option 304 can include the following: "Player Type" option 306, "Sport" option 312, "Wagering Selections" option 318, "Interface" option 324, and "Main Menu Settings" option 328.

"Player Type" option 306 may allow the wagerer to select the player type 308 (e.g., beginner, intermediate, advanced). Wagerers at different playing levels can have different wagering displays attuned to their wagering experience. For example, an advanced wagerer may use an advanced wagering interface that provides all wagering selections on a single screen using abbreviated fields. This way, the wagerer is not bogged down by unnecessary information, such as the full names of tracks, horses, or race times (which the wagerer is already familiar with). For a novice wagerer, the wagering interface may list more detailed fields for ease of understanding the wagering selections. Once a player type has been selected, the wagerer may set the selected player type as a default 310. The default setting causes the selected setting to automatically display instead of changing the interface to the desired player type each time the wagerer wants to make a wager.

"Sport" option 312 may allow the wagerer to select the sport to wager 314. The different wagering sports may include auto racing, basketball, baseball, boxing, football, golf, horse racing, or any other suitable wagering sport. Each wagering sport may present unique wagering interfaces due to different relevant statistics pertaining to each sport. Once a wagering sport has been selected, the wagerer may be asked whether he or she wants this sport set as a default 316 for subsequent accesses to the wagering interface.

"Wagering Selections" option 318 may allow the wagerer to set default wagering selections 320. For example, if horse racing is selected and the user normally wagers at the track Aqueduct every Monday with a Quinella wager in the amount of $100.00, the wagerer may set these wagering options as the default 322. When the wagerer accesses the wagering interface to build a wager, these selections may already be listed in the appropriate fields. The wagerer can then simply skip the preselected fields or may change the fields for a particular wager. If the wagerer changes the fields, the next time that the wagerer accesses the wagering interface, the default wagering selections will be displayed.

"Interface" option 324 may allow the wagerer to select possible interfaces (or platforms) 326 that the user can wager from. The wagerer may choose from any or all of the following platforms: set-top box 14, computer 16, wireless device 18, telephone 20, or any other suitable electronic device.

"Main Menu Settings" option 328 may allow the wagerer to customize the main menu settings on a user interface for each wagerer on each platform. First, the wagerer selects the platform he or she wants to customize 330. The wagerer can customize the interface on each platform uniquely or identically. Next, the wagerer may select and order the menu options to be displayed 332. The wagerer may choose to delete options that will never be accessed from the selected interface. The wagerer may want to order the options so that those most frequently accessed are listed at the top of the menu. This is preferable when using a two-way data enabled cellular telephone since the screen can only display a limited amount of text at a time and in order for the wagerer to view more options, the wagerer must scroll down the list. Once the options are selected and ordered, the wagerer may have the opportunity to set these options as the default setting 316 for subsequent accesses to selected user interfaces.

Figure 9:
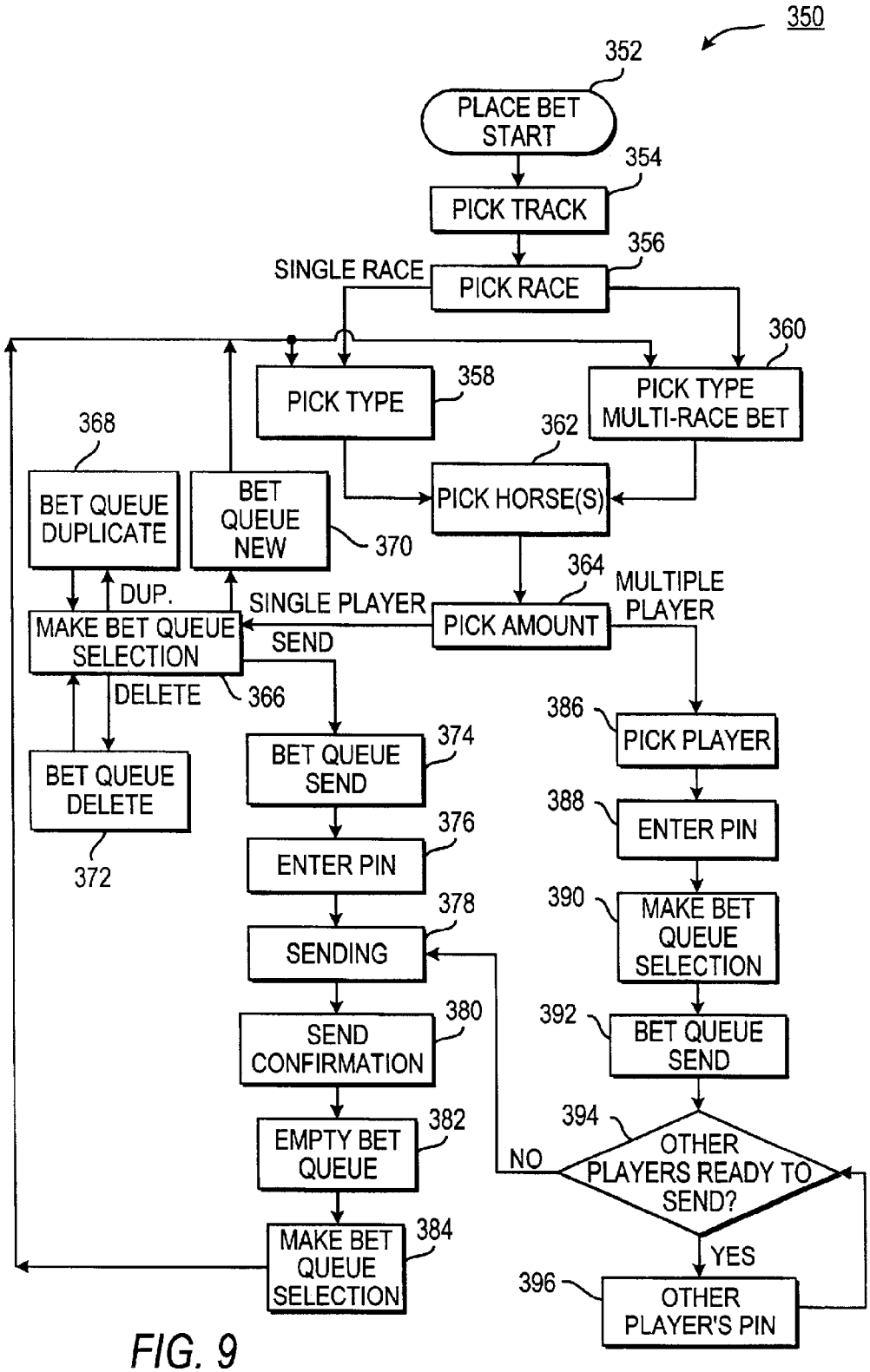
FIG. 9 is a flow diagram illustrating one embodiment of a place bet mode in accordance with the main menu of FIG. 6.

FIG. 9 is a flow chart illustrating a place bet mode 350. A wagerer can select "Place Bet" option 350 from main menu 200 (FIG. 6) to build a wager. This wagering interface may be provided as a default setting for a beginner wagerer. Once place bet mode has been selected 352, the wagerer may be led through a series of fields that need to be filled out. The selections can be made using a remote control, a keyboard, or any other suitable device. At step 354, the wagerer can select a track (e.g., Aqueduct, Gulfstream, Oaklawn, Santa Anita, Turfway Park, etc.). The wagerer can then select a race or multiple races, which may be listed by starting times, at step 356. Depending on the time of the wager, some races may already be completed and are therefore not available as race options.

Next, the wagerer can select the type of wager. If the wagerer is uncertain about a particular field, the wagerer may be able to access a help function to obtain a description of the field. If the wagerer has chosen a single race bet, the wagerer may select the type of wager (e.g., win, place, show, exacta, quinella, trifecta, etc.) at step 358. If the user has chosen a multi-race bet (MRB), the user may select the type of wager (e.g., daily double, pick 3, pick 4, etc.) at step 360. Depending on the type of wager, the wagerer may then select the horse or horses (e.g., Parilla, Kris' Intention, D. J.'s Choice, Timely Kitten, etc.) at step 362 for each race chosen and type of wager. Once the horse (or horses) has been chosen, the wagerer can select a wagering amount at step 364.

The wagering interface can determine whether a single player is, or multiple players are, active by referring to the status of the players setup, which may be stored in subscriber management system 30 or database 104 of hub 12. If a single player is active, the wagerer is shown a bet queue at step 366 listing all current wagering selections and available options. The wagerer has the option of duplicating a bet 368, adding a new bet 370, deleting a bet 372, or sending the bet queue 374. The wagerer can duplicate or delete a bet by selecting the desired bet to duplicate or delete, respectively. The bet queue may be updated to reflect the duplicated or deleted bet, or the addition of a new bet.

Once all desired bets are in the bet queue, the wagerer can request to send the bet queue 374. At step 378, the wagering interface prompts the wagerer for the player's pin. After the wagerer has correctly entered the pin, the wagering interface may then display a window signaling the sending of the bet queue at step 378. If the transmission of any of the bets in the bet queue is unsuccessful (e.g., because of insufficient funds in the wagerer's account, missing required fields, a selected horse has been scratched, a race has been canceled due to weather, etc.), the bet may be listed on a display screen as not being sent. All bets that have been successfully sent can be displayed in a confirmation window at step 380. The bet queue will then be cleared at step 382 and additional bet queue selections can be made at step 384.

If multiple players are active, the wagerer may be prompted to select the player name at step 386 and to enter in the corresponding pin at step 388. Next, the wagerer is shown a bet queue at step 392 (similar to the bet queue at step 366 for single players) listing all current wagering selections pertaining to each player and available options. The wagerer may request to send in the bet queue at step 392. At step 394, the wagering interface may prompt the user to indicate which player accounts have bets that are ready to be sent. If other players are ready to send, the pins associated with each player's account can be entered at step 396. If no other players are ready to send, the wagering interface then sends the bets as described in connection with steps 378, 380, 382, and 384 above.

Figure 10:
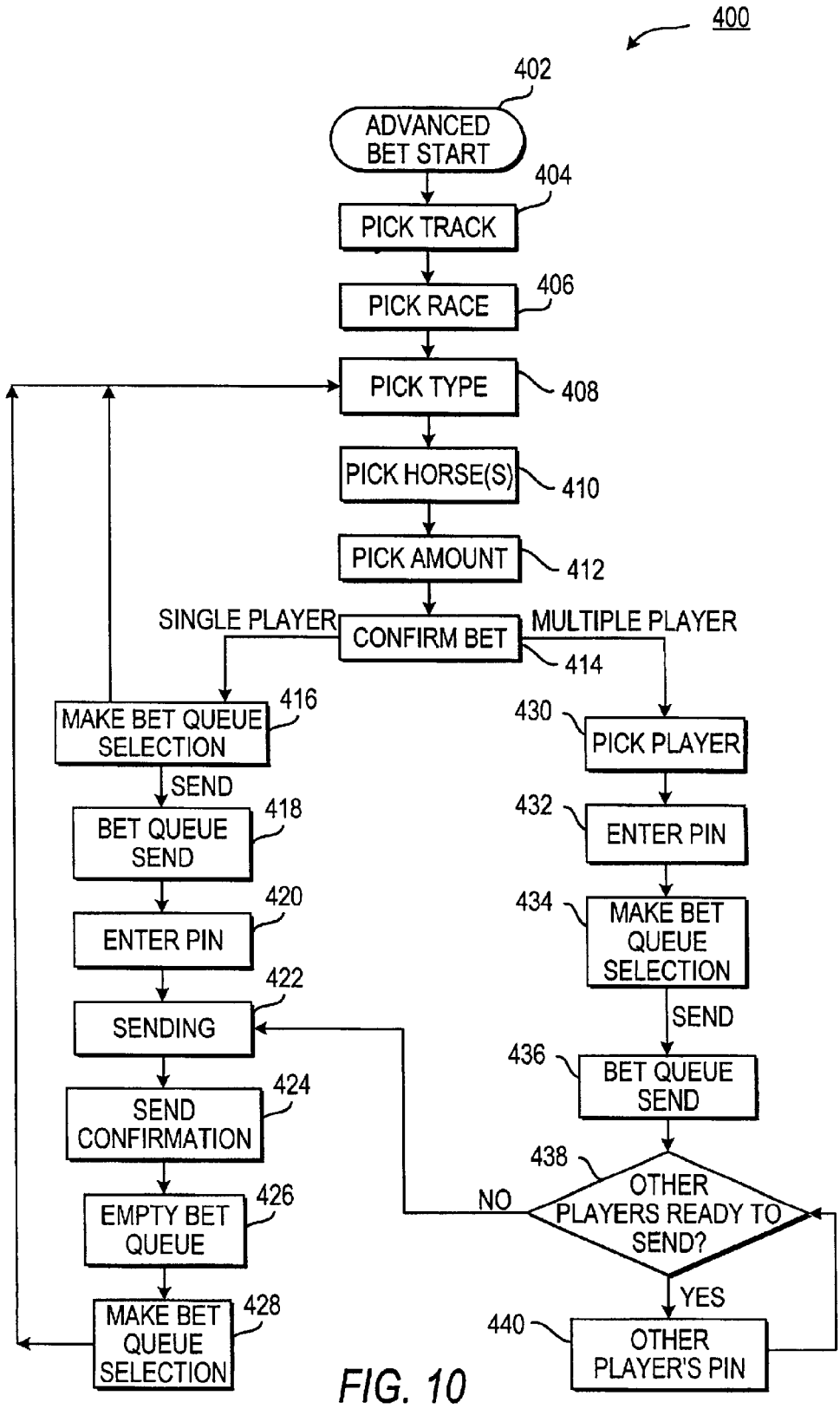
FIG. 10 is a flow diagram illustrating one embodiment of an advanced bet mode in accordance with the main menu of FIG. 6.

FIG. 10 is a flow chart illustrating an advanced bet mode 400. A wagerer can select "Place Bet Menu" 350 from main menu 200 (FIG. 6) to build a wager. If the wagerer has selected advanced wagering as the default setting, an advanced wagering mode is displayed 402 instead of the novice bet mode illustrated in FIG. 9. The display for advanced wagering may be displayed on a single screen with abbreviated field terms. The wagerer can select a track at step 404 from a listings of track names in abbreviated form (e.g., "AQU," "GUL," "OAK," "SAN," and "TUR" may indicate the common race tracks "Aqueduct," "Gulfstream," "Oaklawn," "Santa Anita," and "Turfway Park," respectively). Next, at step 406, the wagerer can pick a race which may include "MRB" (multi-race bet) and race numbers (race starting times). At step 408, the wagerer can select the type of wager for single and multi-race bets (e.g., "WIN," "PLC," "SHW," "EXA," "QUI," "TRI," "DLD," "PK3," and "PK4" may indicate the common types of wagers "Win," "Place," "Show," "Exacta," "Quinella," "Trifecta," "Daily Double," "Pick 3," and "Pick 4," respectively). Once the wager type is selected, the appropriate number of horses is selected at step 410. The amount to wager is selected at step 412 and the bet is confirmed at step 414.

Similar to the interface for place bet mode 350, the wagering interface can determine whether a single player is or multiple players are active. Depending on whether there is a single player or multiple players, the rest of the process of placing a wager follows the steps described in FIG. 9. For a single player, a bet queue selection may be made at step 416, the wagerer can request to send in the bet queue at step 418 and the player's pin can be entered at step 420. If the pin is correct, the bet queue is sent at step 422 and a confirmation is returned at step 424 if the send is successful. At step 426, the bet queue is cleared and a new bet queue selection can be made at step 428. For multiple players, the player can be selected at step 430 and that player's pin can be entered at step 432. At step 434, a bet queue selection may be made and the wagerer can request to send in the bet queue at step 436. The wagering interface can ask if other players are ready to send at step 438. If there are other players, those player's pins are entered at step 440, but if there are no other players, the bet queue may be sent at step 422 and the process follows steps 424, 426, and 428 as described above for a single player.

Figure 11:
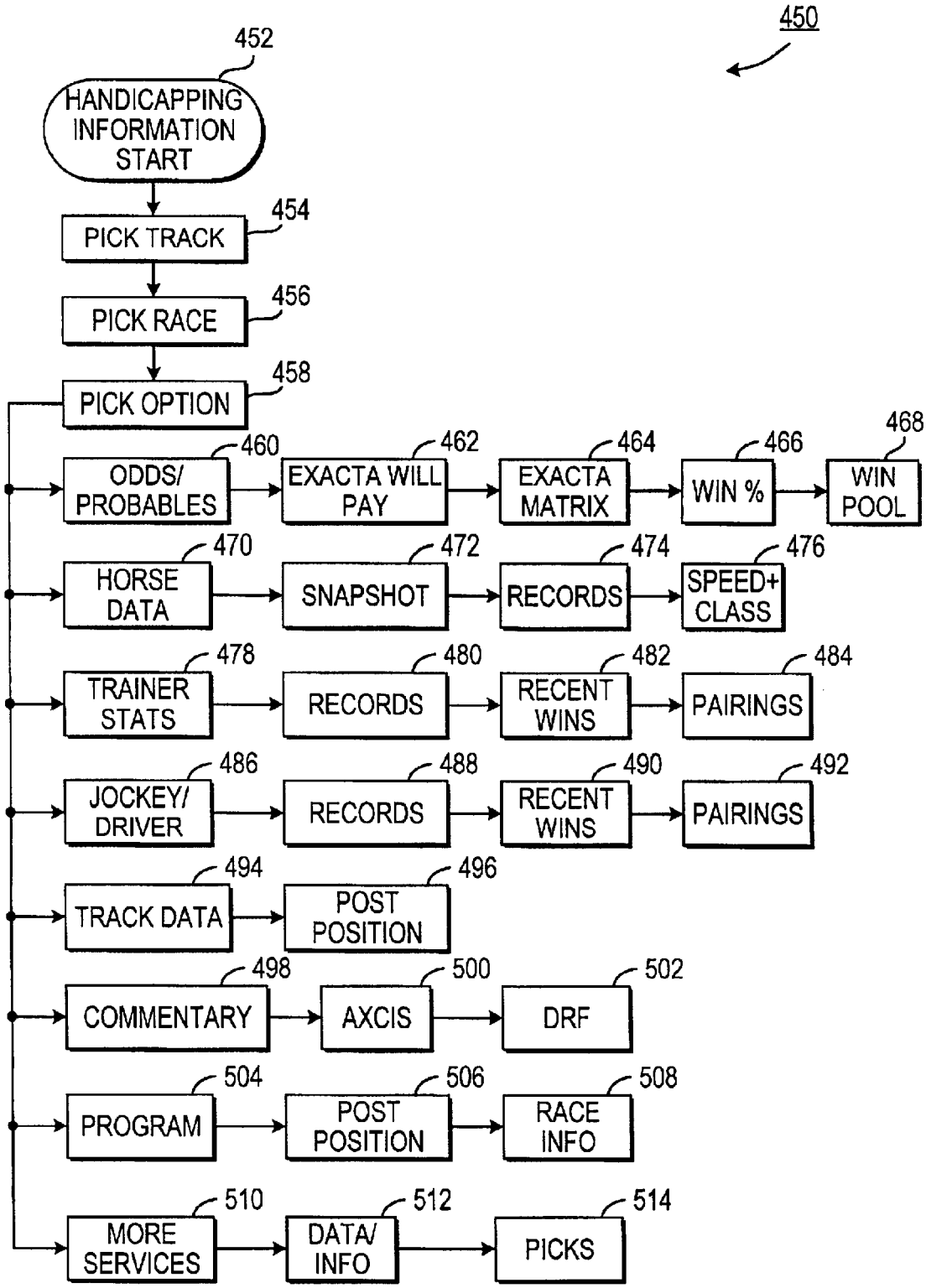
FIG. 11 is a diagram illustrating one embodiment of a handicapping information mode in accordance with the main menu of FIG. 6.

FIG. 11 is a diagram illustrating wagering handicapping information menu 450. A wagerer can select "Handicapping Information Menu" 450 from main menu 200 (FIG. 6) to access handicapping information 452, which enables the wagerer to view information related to a selected wagering sport. Once the wagerer has selected a track at step 454 and a race at step 456, the following options 458 can displayed: "Odds/Probables" option 460, "Horse Data" option 470, "Trainer Stats" option 478, "Jockey/Driver" option 486, "Track Data" option 494, "Commentary" option 498, "Program" option 504, and "More Services" option 510. "Odds/Probables" option 460 may allow the wagerer to obtain information on the odds or probabilities on each of the horses for a selected track and race. The wagerer can see the payout on, for example, a $2 bet for an exacta bet on a selected horse (i.e., "Exacta Will Pay" 462), or a $2 bet for an exacta bet on every horse (i.e., "Exacta Matrix" 464) for the selected track and race. The payout may be for any amount and may be for an exacta wager or any other type of wagering. Also available to the wagerer can be a chart of the percentage of all bets placed so far for each horse for each type of wager (i.e., "Win %" 466). The total value of the wagers placed for any horse for a particular type of wager may be listed along the bottom of the display screen. The wagerer may also view the total value of the wagers placed for each horse for each type of wager (i.e., "Win Pool" 468). As with "Win %" 466, the total value of the wagers placed for each type of bet may be listed along the bottom of the display screen. For "Exacta Will Pay" 462, "Exacta Matrix" 464, "Win %" 466, and "Win Pool" 468, the wagerer may have the opportunity to establish a wager from the selected horse and type of wager.

"Horse Data" option 470 may allow the wagerer to obtain information on each horse for a selected track and race. The wagerer can view "Snapshot" 472, "Records" 474, and "Speed+Class" 476 data for each horse. "Snapshot" data 472 may include a number of days off, a number of wins and starts, a power rating (any suitable method for comparing horses), and a morning line for each horse. "Records" data 474 may include a number of races by, a number of first and second place standings for, and wagering winnings on, each horse. "Speed+Class" data 476 may include a speed in the last race, an average speed, a current class, and a last class for each horse.

"Trainer Stats" option 478 may allow the wagerer to obtain information on each trainer for a selected track and race. The wagerer can view "Records" 480, "Recent Wins" 482, and "Pairings" 484 data for each trainer. "Records" data 480 may include the number of races, first and second place standings, and an average for the trainer of each horse. "Recent Wins" data 482 may include a number of wins in the last 10 races, 20 races, and 50 races for the trainer of each horse. "Pairings" data 484 may include a number of starts and wins with this horse and a number of starts and wins with this jockey, for the trainer of each horse.

"Jockey/Driver" option 486 may allow the wagerer to view jockey and driver handicapping data. The wagerer can view "Records" 488, "Recent Wins" 490, and "Pairings" 492 data for each jockey and driver. "Records" data 488 may include a number of races, first and second place standings, and an average for the jockey or driver of each horse. "Recent Wins" data 490 may include a number of wins in the last 10 races, 20 races, and 50 races for the jockey or driver of each horse. "Pairings" data 492 may include a number of starts and wins with this horse and a number of starts and wins with this trainer, for the jockey or driver of each horse.

"Track Data" option 494 may allow the wagerer to view track statistics data. The wagerer can view "Post Position" 496 data, which may include a weighted win average for each post position of the track. The weighted win average can be calculated using any suitable method.

"Commentary" option 498 may allow the wagerer to view commentary data from any handicapping data provider connected to wagering system 10. For example, handicapping data may be available from two handicapping data providers 38 called "AXCIS" 500 and "DRF" 502.

"Program" option 504 may allow the wagerer to view program data on the selected race. The wagerer can view "Post Position" 506 or "Race Info" 508 data. "Post Position" data 506 may be the post position for each horse. "Race Info" data 508 may include race length, track type (e.g., turf, mud, etc.), race type (e.g., claiming), purse amount, horse category, jockey weight class, claiming price, and any other suitable information.

"More Services" option 510 may allow the wagerer to view "Data/Info" 512 or "Picks" 514 data. The wagering interface may display general information such as telephone numbers and Internet addresses that may be used by the wagerer to receive additional data, information, or picks. "Picks" option 514 may be offered for a fee. When selected, the wagerer may be prompted for his or her account pin to authorize a charge of the fee to the player's account.

Figure 12:
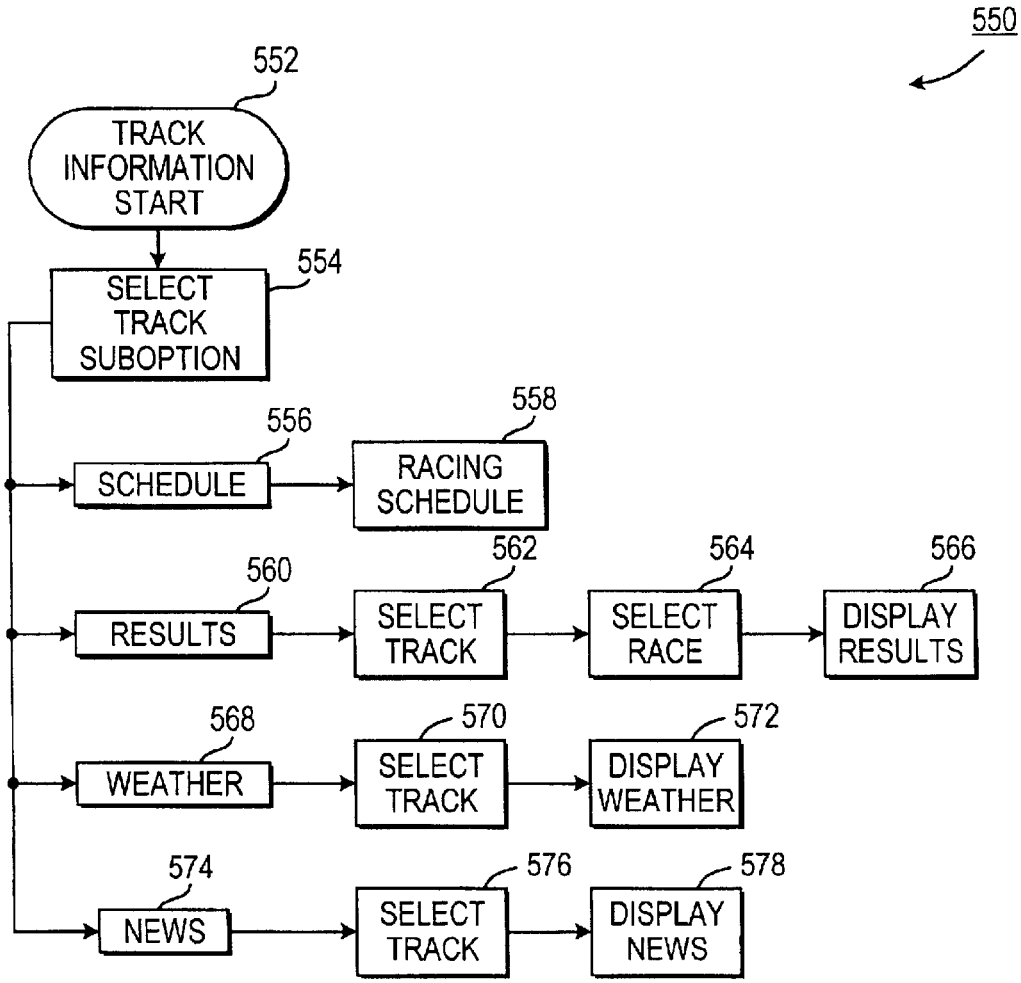
FIG. 12 is a diagram illustrating one embodiment of a track information mode in accordance with the main menu of FIG. 6.

FIG. 12 is a diagram illustrating track information menu 550. The wagerer may select "Track Information" option 550 from main menu 200 (FIG. 6) to access track information menu 552, which can have the following options 554: "Schedule" 556, "Results" 560, "Weather" 568, and "News" 574.

"Schedule" option 556 may allow the wagerer to view a racing schedule 558. The wagering interface may display the racing schedule information for the selected day.

"Results" option 560 may allow the wagerer to view racing results by selecting a track 562 and a race 564. Each race option may include a race number, an indication signaling whether the selected race is finished, and a post time for races that have finished. The wagering interface may only allow the wagerer to select from races that have already finished. The wagering interface displays results 566 such as a listing of first five, or any suitable number, of finishing horses and payouts for those horses for the different wagering types.

"Weather" option 568 may allow the wagerer to view weather information for a selected track 570. The wagering interface displays weather information 572 such as forecast data or current condition data. This information may include an indication of the date, city, cloud coverage, temperature, track condition, wind level and direction, humidity, barometric pressure, and any other suitable information.

"News" option 574 may allow the wagerer to view news information. Once the wagerer has selected a track 576, the wagering interface may then display any track-related news 578 that may be of interest to the wagerer.

Figure 13:
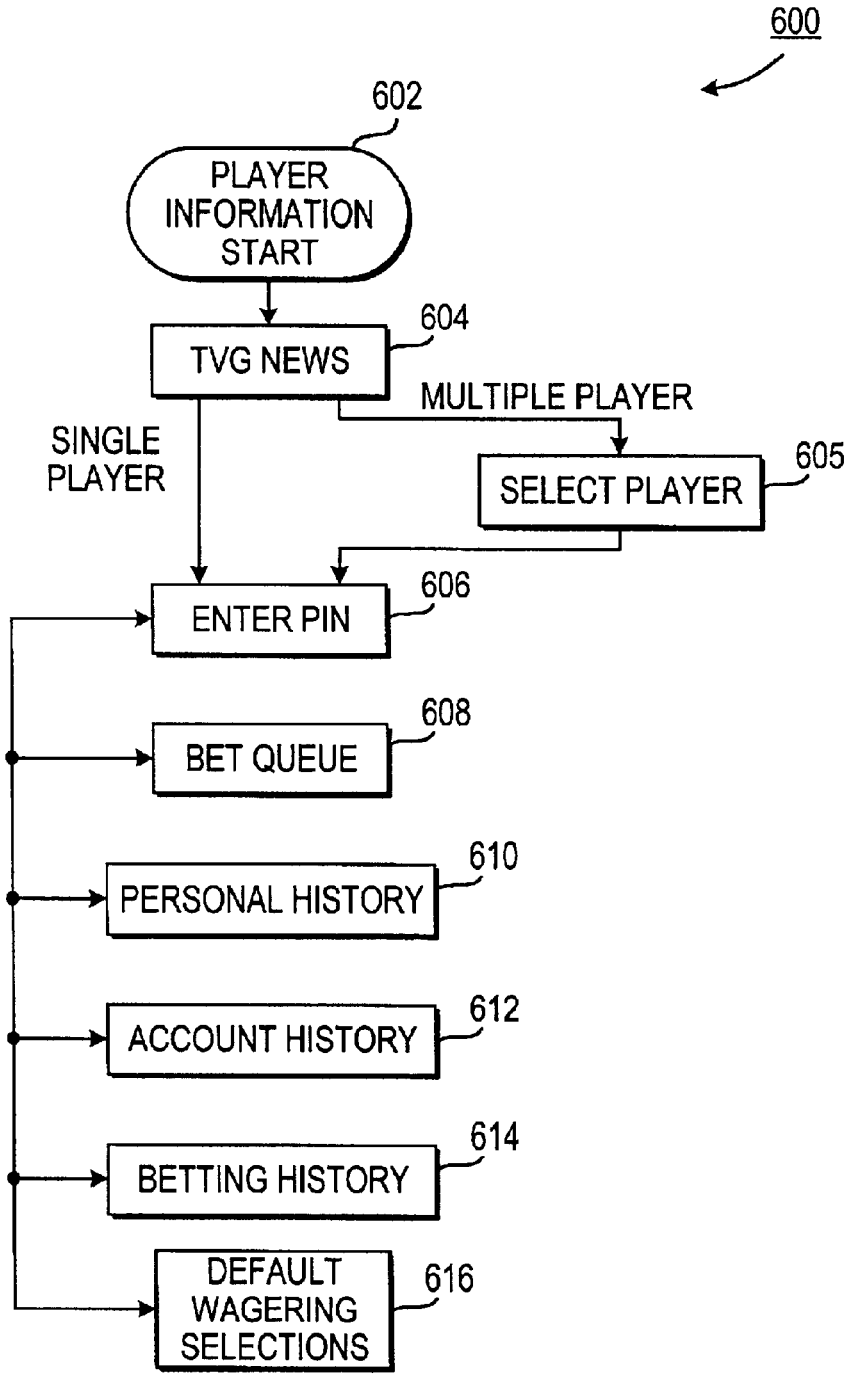
FIG. 13 is a diagram illustrating one embodiment of a player information mode in accordance with the main menu mode of FIG. 6.

FIG. 13 is a diagram illustrating player information menu 600. A wagerer may select "Player Information Menu" option 600 from main menu 200 (FIG. 6) to access menu 602, which may contain the following options: "Bet Queue" 608, "Personal History" 610, "Account History" 612, "Betting History" 614, and "Default Wagering Selections" 616.

When the wagerer first selects "Player Information Menu" 600, the wagering interface may display any news 604 related to the service provided by the operator of wagering system 10. This information may be particular to a player's accounts or may be general information. If multiple players are currently accessing the wagering interface, the interface may next prompt the wagerer to identify a player account and to enter a pin 606. Once the wagerer has entered the correct pin, the menu options may be displayed.

"Bet Queue" option 608 may list the wagerer's current wagering selections. These selections may include a track, race, wager, amount, and horse (or horses) of any recent bets. The wagerer may also check the status of the race. If the race has not yet begun, a display to that effect may be shown. If a race is currently in progress, there may be real-time updates on the current status of the race. Results of completed races may be posted.

"Personal History" option 610 may contain the wagerer's demographic information. Information may be posted with the player's name, address, telephone number, and any other relevant information. The wagerer may have an opportunity to view and edit the information.

"Account History" option 612 may contain the wagerer's wagering credit history. Information may be posted with the wagerer's credit card number, a listing of charges (i.e., losses and fees) and credits (i.e., wins), net balance, checks or money orders received, and any other relevant information.

"Betting History" option 614 may contain the wagerer's betting history. This wagering history may be for only a limited period of time and may include date, track, race, per bet amount, type, selected horses, total cost, and any other suitable information for each wager in the player's history.

"Default Wagering Selections" option 616 may contain the wagerer's default preferences as described in FIG. 8. These selections may include player type, sport, wagering selections, interface, and main menu settings. From here, the wagerer may have an opportunity to view and edit any of the default settings.

Finally, the wagerer may select "Help Menu" 650 from main menu 200 (FIG. 6) to access help information. This may include an introduction to the wagering interface, an explanation of the menu options and features, a search tool to reference the various wagering fields and wagerer information, and any other relevant information.

As explained above in connection with FIGS. 1–3, by providing centralized data storage using database 104 in wagering data hub 12 and subscriber database 130 in subscriber management system 30, the preferences menu (FIG. 8) and player information menu (FIG. 13) may reflect wagers made using set-top box 14, computer 16, wireless device 18, and/or telephone 20.

Figure 14:
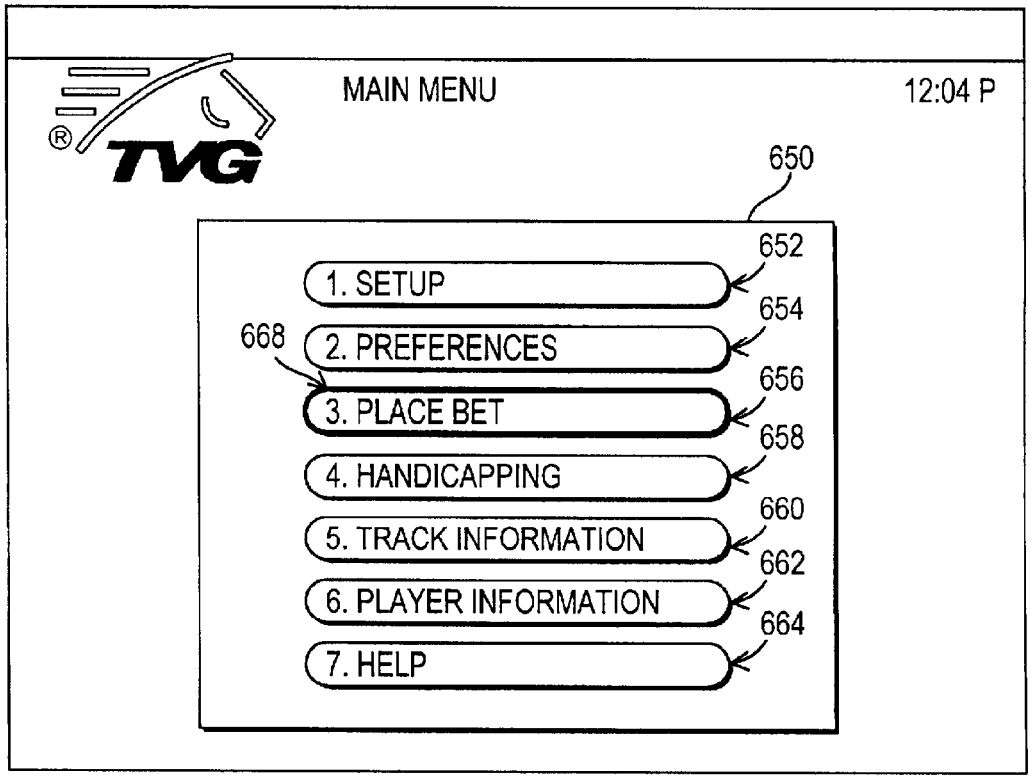

FIGS. 14–19 illustrate display screen shots of the wagering interface using set-top box 14 and/or computer 16 in accordance with one embodiment of the present invention. The screen displays for the wagering interface may be part of a television programming guide screen, may be displayed on a web page browser, or may be illustrated using any suitable method. FIG. 14 illustrates main menu 650 for the wagering interface. In accordance with the flow chart of main menu 200 in FIG. 6, main menu 650 can have the following options: "1. Setup" 652, "2. Preferences" 654, "3. Place Bet" 656, "4. Handicapping" 658, "5. Track Information" 660, "6. Player Information" 662, and "7. Help" 664. A wagerer may select one of the main menu options by pressing the number of the desired option or by moving highlighted bar or outlined box 668 around the desired option and pressing an enter key on a device such as a remote control or keyboard.

Figure 15:
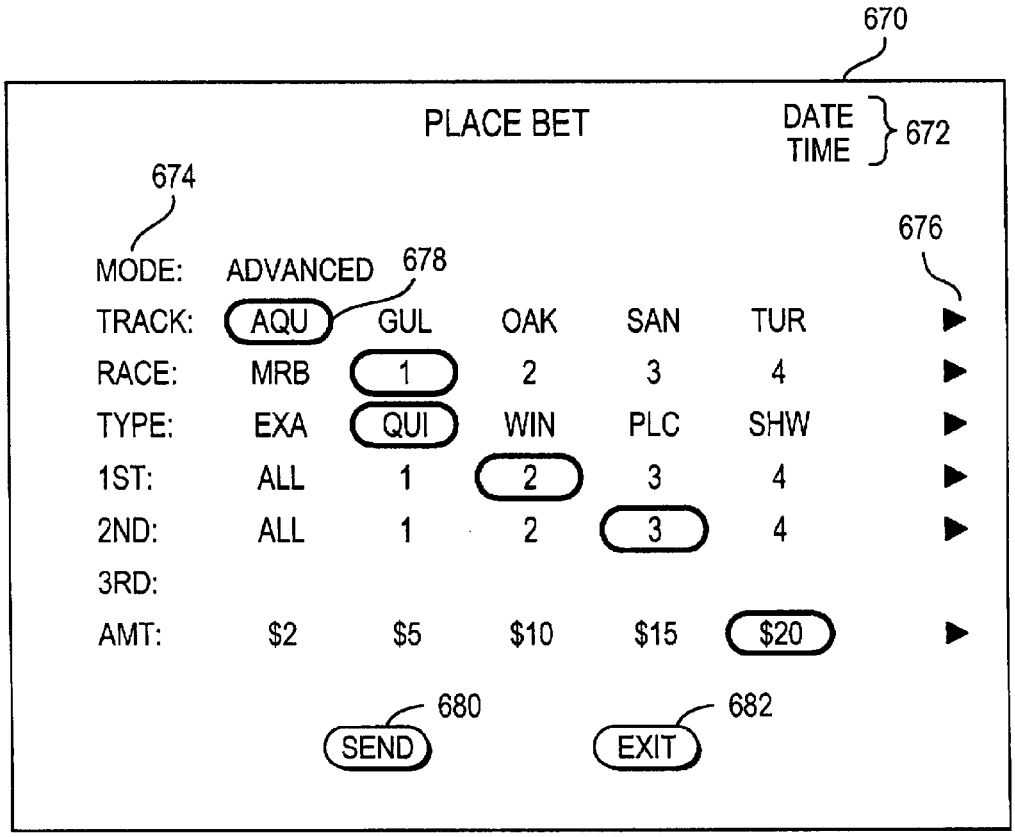

FIG. 15 illustrates place bet mode 670 that can be displayed when a wagerer selects "3. Place Bet" option 656 on main menu 650. Display screen 670 can contain the current date and time 672. Display screen 670 illustrates a selected default betting mode 674 (e.g., one of beginner, intermediate, or advanced mode), with the corresponding wagering fields (e.g., track, race, type, horses, amount).

FIG. 15 may follow the flow chart of the advanced bet mode 400 in FIG. 10. In advanced bet mode 674, all of the fields may be displayed on a single screen instead of multiple screens. Screen 670 may list all available choices for the corresponding fields in abbreviated form with arrows 676 signaling more options. The field choices may be listed in alphabetical order, listed according to default settings, listed according to most recent or most frequently accessed, or any other suitable order. The wagerer may select the desired options by moving an outlined box 678 to the desired choice for each field. Outlined box 678 may initially be outlining the leftmost choice, may outline the most recent wagering selections, or may outline the default selection. At the bottom of screen 670 may be "Send" button 680 to send the bet queue and "Exit" button 682 to return to the previous screen.

Figure 16:
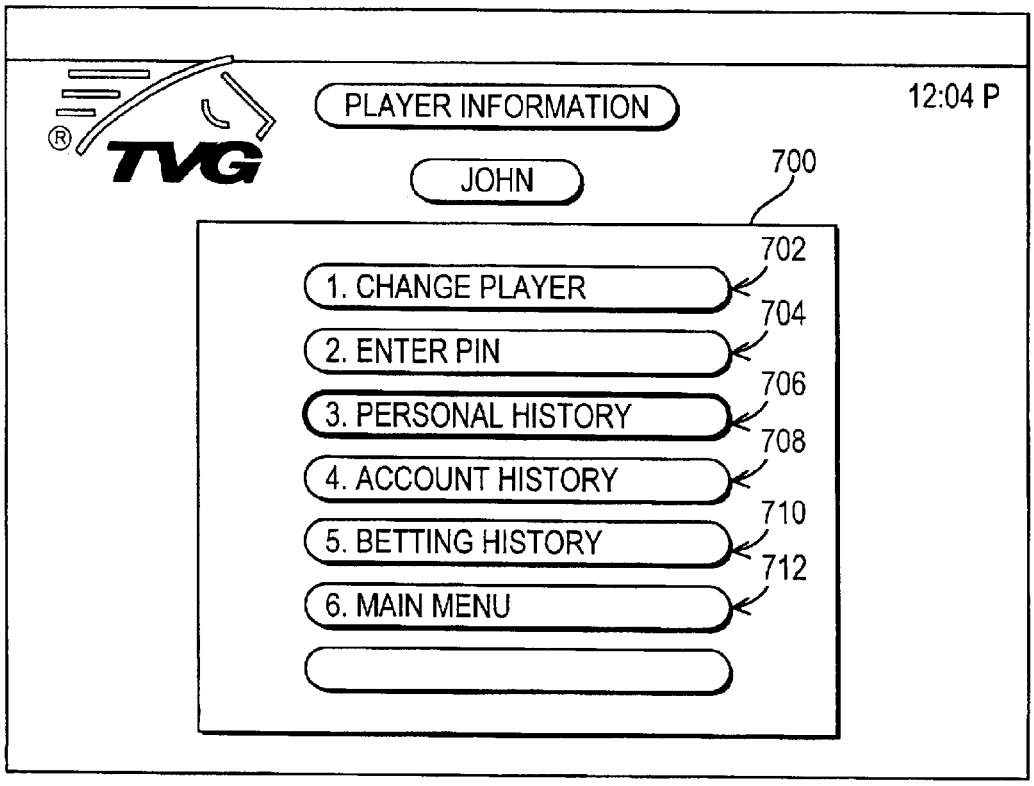

FIG. 16 illustrates player information menu 700 that can be displayed when the wagerer selects "6. Player Information" option 662 on main menu 650. In accordance with the flow chart of the player information menu 600 in FIG. 13, submenu 700 can contain the following options: "1. Change Player" 702, "2. Enter Pin" 704, "3. Personal History" 706, "4. Account History" 708, "5. Betting History" 710, and "6. Main Menu" 712.

Figure 17:
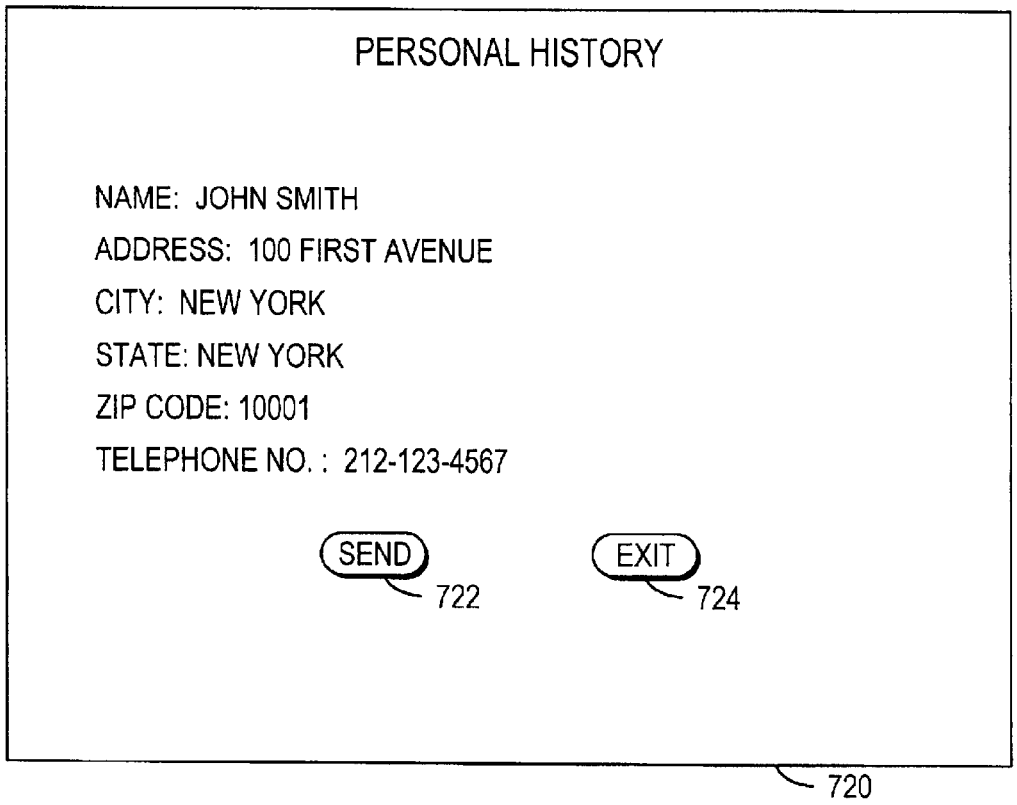

FIG. 17 illustrates display 720 if the wagerer selects "3. Personal History" option 706 (FIG. 16). The wagerer's personal history can include the account name, address, and telephone number of the wagerer. There can also be two buttons at the bottom of the screen. "Edit" button 722 may allow the wagerer to edit the personal history information. "Exit" button 724 may allow the wagerer to either return to the previous screen or return to the main menu.

Figure 18:
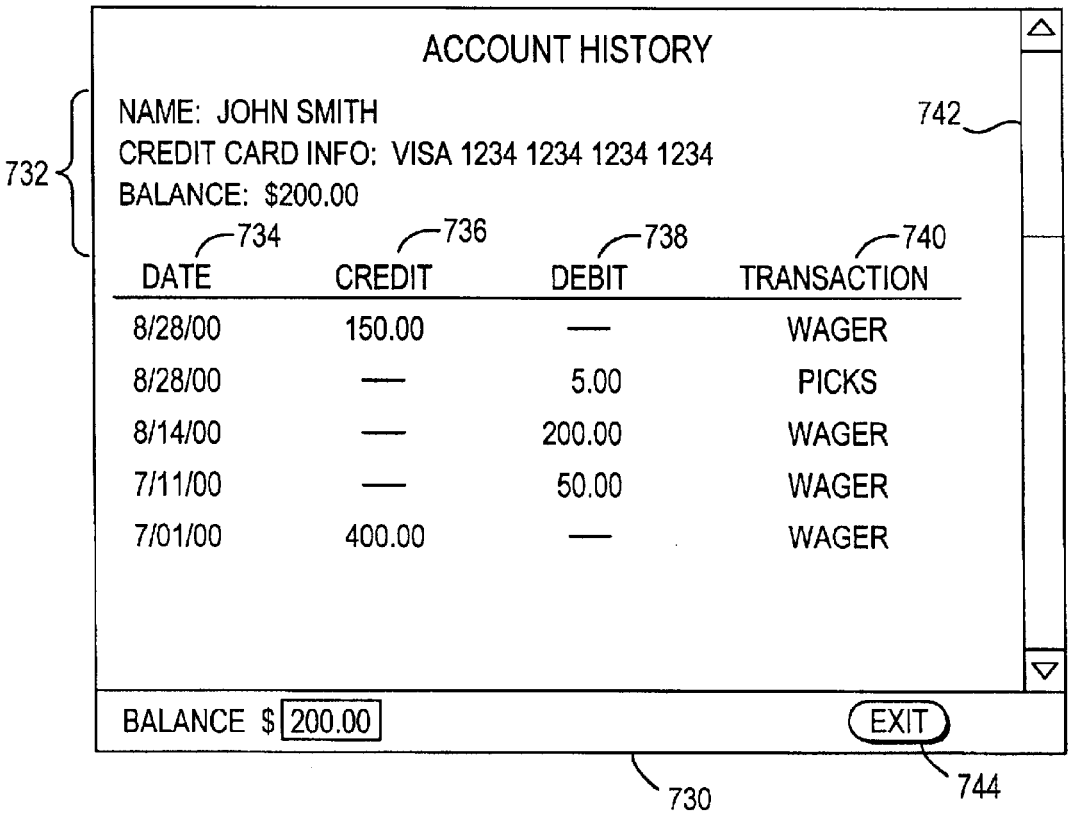

FIG. 18 illustrates display 730 if the wagerer selects "4. Account History" option 708 (FIG. 16). Display 730 can include the account name, any suitable account number (e.g., pre-assigned number, credit card number), and current balance. Display 730 can also illustrate a table containing information on wagers made using the account, including date 734, credits 736, debits 738, and transactions 740. The date of the wager may be listed from most recent to least recent wager. The account history may only include information for a given month, may be limited to a certain number of wagers, may be listed up to the last debit amount that was paid, or any other suitable listing. Credit 736 and debit 738 can list the wins credited to the account and the losses or fees (e.g., accessing "Picks" for wagering help) charged to the account, respectively. The credits 736 and debits 738 may be listed together (differentiated by a plus or minus sign, respectively) or separately. Transactions 740 may indicate either a wager or a fee. The wagerer may view more account history by using scroll bar 742 to move the display screen up and down accordingly. At the bottom of the screen may be "Exit" button 744 to either return to the previous screen or the main menu.

FIG. 19 illustrates display 750 when the wagerer selects "5. Betting History" option 710 (FIG. 16). Display 750 can include the date of all recent wagers 752, the wagering selections 754 for a particular date, results from a selected race 756, and net amount 758. The date 752 may be listed in descending order from most recent wager to least recent, or any other suitable order. If more than one race for a given day was wagered on, the date may be repeated to list all wagers and results for each race. Wagering selections 754 can include track, race, amount of wager, type of wager, and horse(s) wagered on. Results 756 can include the first three horses that won a selected race. Net amount 758 can indicate the wagering amount that was won or lost. Display 750 may also have scroll bar 760 to allow the wagerer to view additional betting history information. Display 750 can also have "Exit" button 762 to either return to the previous screen or the main menu.

Display screen 750 may differ depending on the player type and the selected default selections. As shown, a wagering interface in advanced mode may show listings using abbreviated fields so that the wagerer may view more on a single screen. For a wagerer in beginner mode, the full names of track, race time, type of wager, and names of horses may be displayed. Less data may be displayed on the screen so the wagerer may have to scroll more often in order to access more history. The wagerer may also select his or her preferences on what to display and how to display the data on screen 750.

FIGS. 20–31 illustrate display screens of a wagering interface using wireless device 18, such as a two-way data enabled cellular telephone. The wagering interface on wireless device 18 may be consistent with the interface on set-top box 14 or computer 16. The wagerer can change some of his or her preferences based on convenience for display on wireless device 18.

Figure 20:
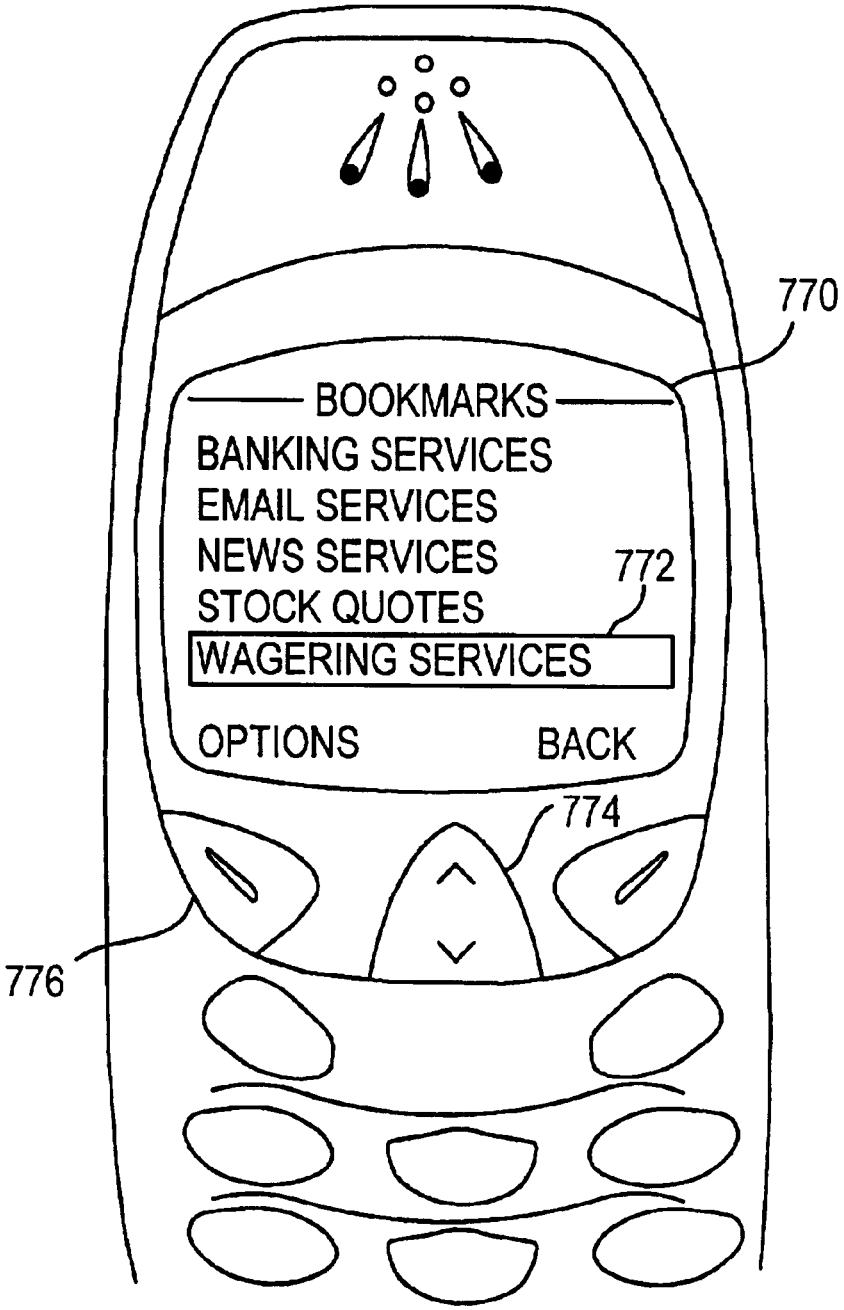
FIGS. 20–31 are illustrations of screen displays that may be presented as part of the wagering interface in a two-way data enabled cellular telephone in accordance with the present invention.

FIG. 20 illustrates a screen display of browser 770 on a two-way data enabled cellular telephone. The wagerer can access wagering services from among a list of web sites that the wagerer has added as a bookmark. "Wagering Services" option may be selected by moving a highlighted bar or outlined box 772 to the desired option using up and down arrow keys 774 and selecting "Options" button 776.

Figure 21:
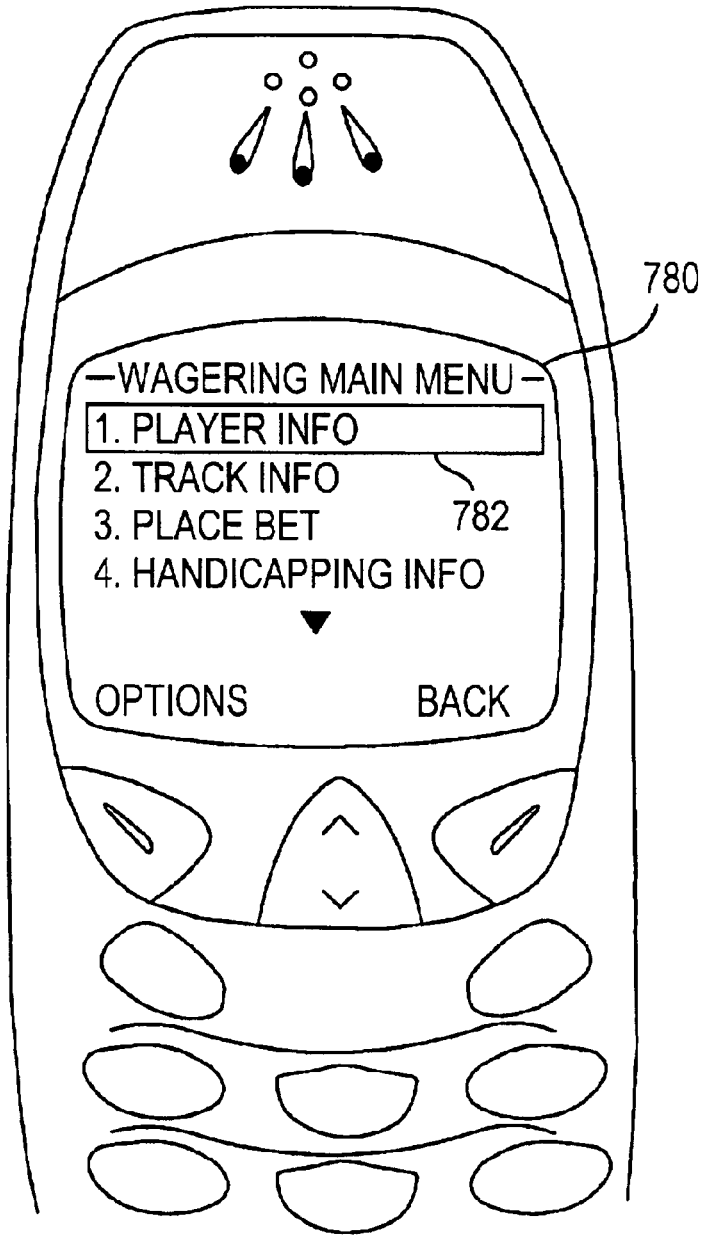
Figure 22:
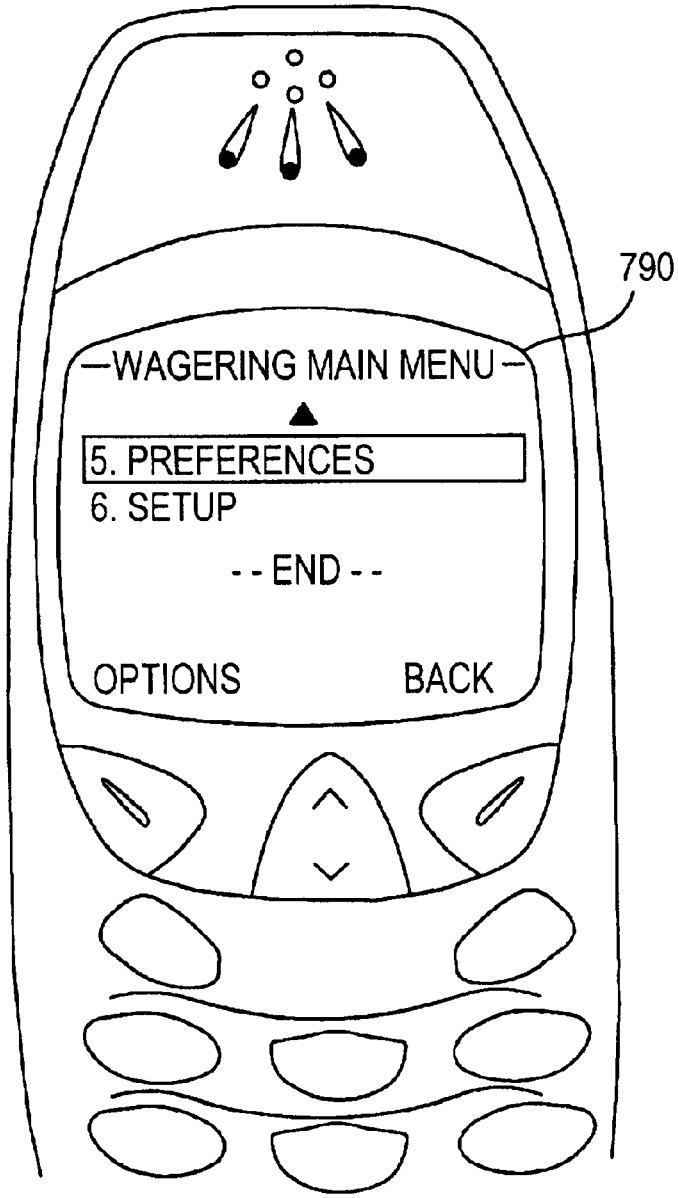
Figure 23:
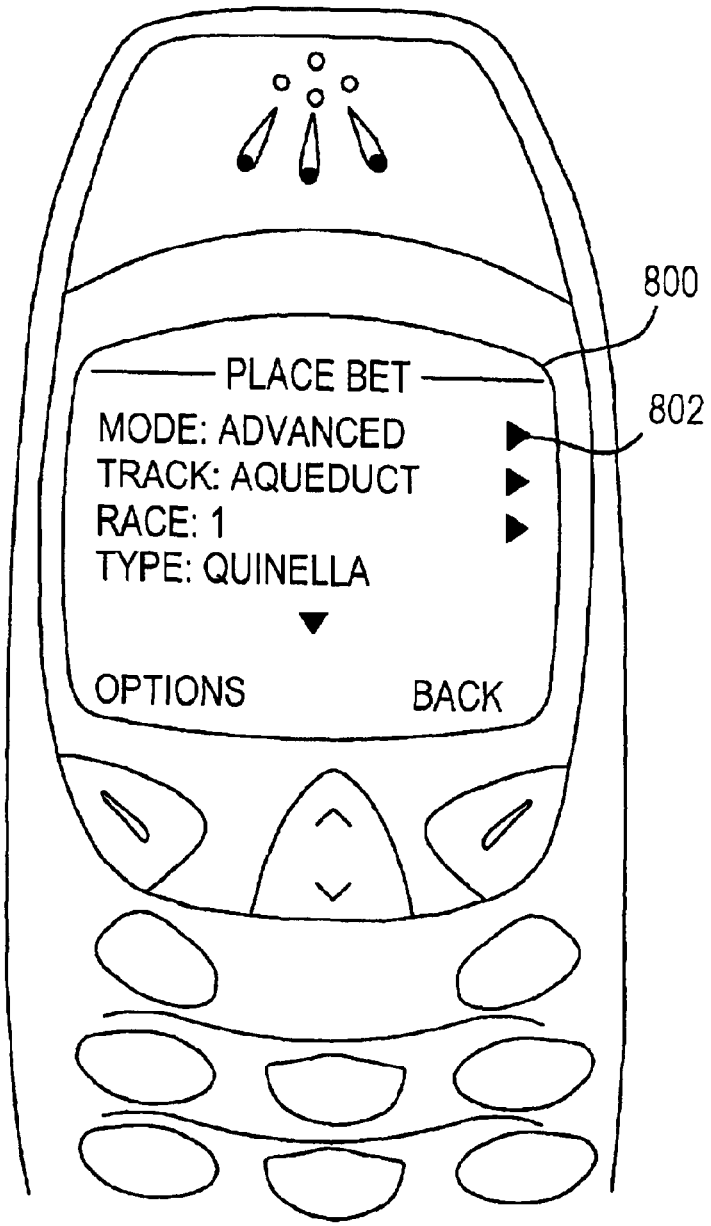
Figure 24:
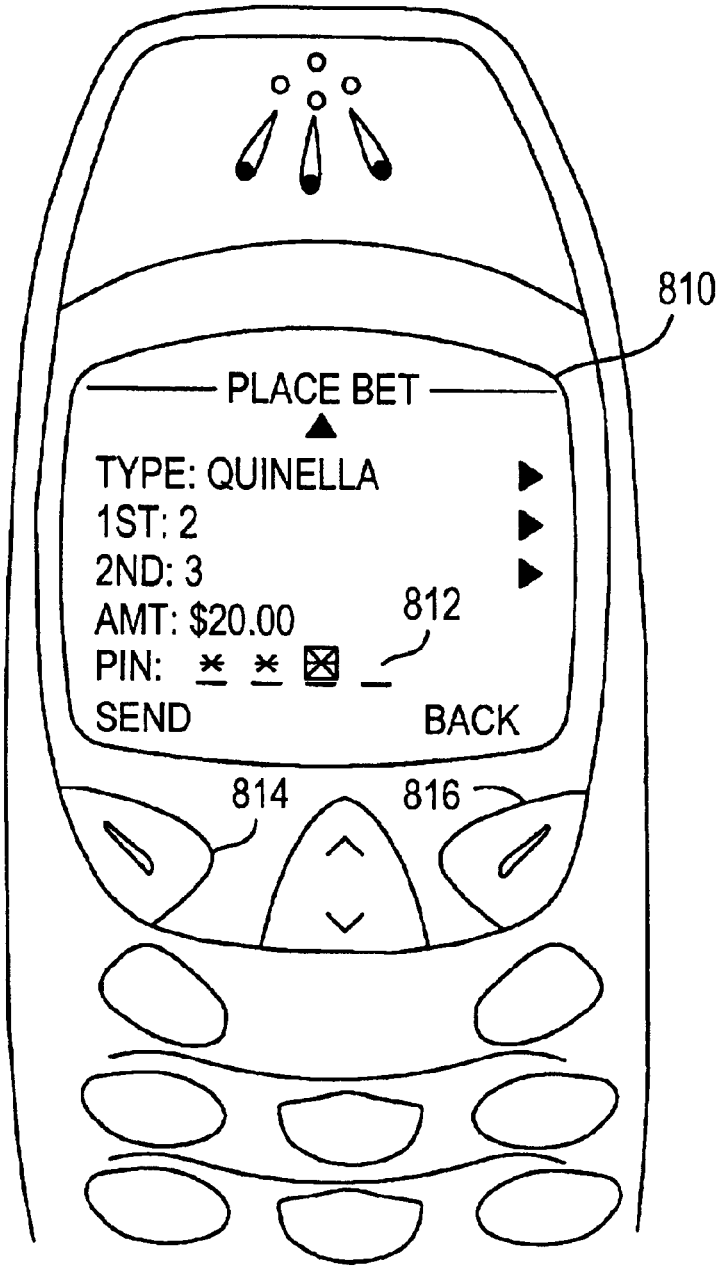

FIG. 21 illustrates a screen display of wagering main menu 780. Due to the small screen size, not all of the main menu options can be displayed on a single screen without the wagerer having to scroll down the list to access the remainder of main menu options 790 as illustrated in FIG. 22. Wagering main menus 780 and 790 may have the same menu options as main menu options 650 (FIG. 14) on set-top box 14 or computer 16, but may be in a different order. More likely, the wagerer may only want to access options such as player information, track information, place bet, and handicapping information from a two-way data enabled cellular telephone rather than accessing options such as preferences and setup. Preferences and setup options may preferably be accessed on set-box 14 or computer 16, where it may be easier to enter in information. Options that may more likely be accessed on a two-way data enabled cellular telephone can be listed on a first display screen 780 so that the wagerer does not have to scroll down the list to access options on display screen 790. The options listed and the order of the options on any of the menus may be set in the preferences option using set-top box 14, computer 16, wireless device 18, and/or telephone 20. FIGS. 23 and 24 illustrate display screens of place bet mode 800 and 810 if the wagerer selects "3. Place Bet" option from wagering main menu 780 (FIG. 21). Place bet mode 800 and 810 provides the same information as place bet mode 670 (FIG. 15) shown using set-top box 14 and/or computer 16. Depending on the selected wagerer preferences made from any wagering interface, the preferences may be displayed on screens 800 and 810. If the wagerer previously set the player mode to advanced bet mode as the default, and also set a certain track, race, wager type, and amount of wager as the default, these options may be displayed on screens 800 and 810. Alternatively, the wagering options listed may be from most recent wager to least recent wager. If the wagerer wishes to change certain fields, the wagerer may move to the desired field and make a new selection by depressing a right or left arrow key as indicated by indicator 802.

Once the wagering selections have been made, the wagerer may enter his or her pin 812 on display screen 810, and may then press "Send" button 814. If a wagerer wishes to return to a previous display screen, the wagerer may press "Back" button 816.

Figure 25:
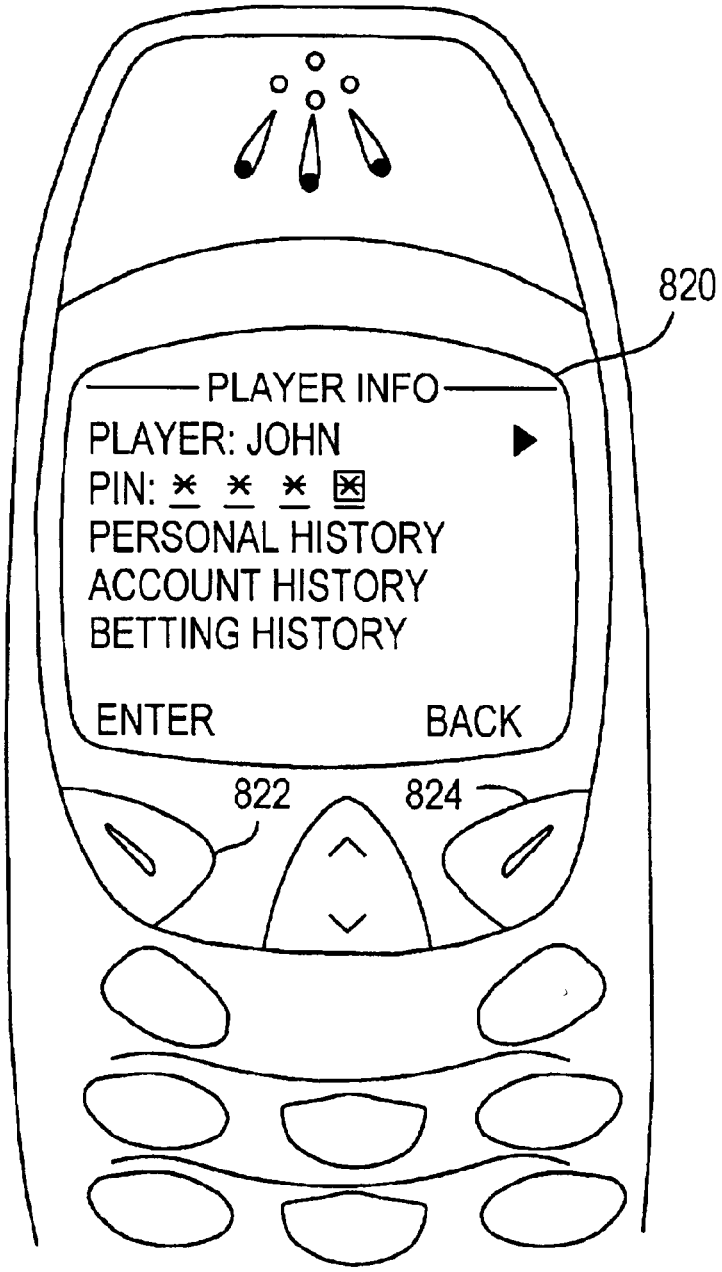

FIG. 25 illustrates player information menu 820 that may be displayed if a wagerer selects "1. Player Info" option on wagering main menu 780 on a two-way data enabled cellular telephone (FIG. 21). Player information menu 820 may provide the same information as menu 700 (FIG. 16) displayed using set-top box 14 and/or computer 16. The wagerer may change the players from among a list of wagerers that use the two-way data enabled cellular telephone, the wagerer may enter in the account's pin, and then the wagerer may select to access personal history, account history, or betting history information by moving a highlighted bar or outlined box to the desired option and pressing "Enter" key 822. Alternatively, the wagerer may press the "Back" key 824 to return to the previous screen.

Figure 26:
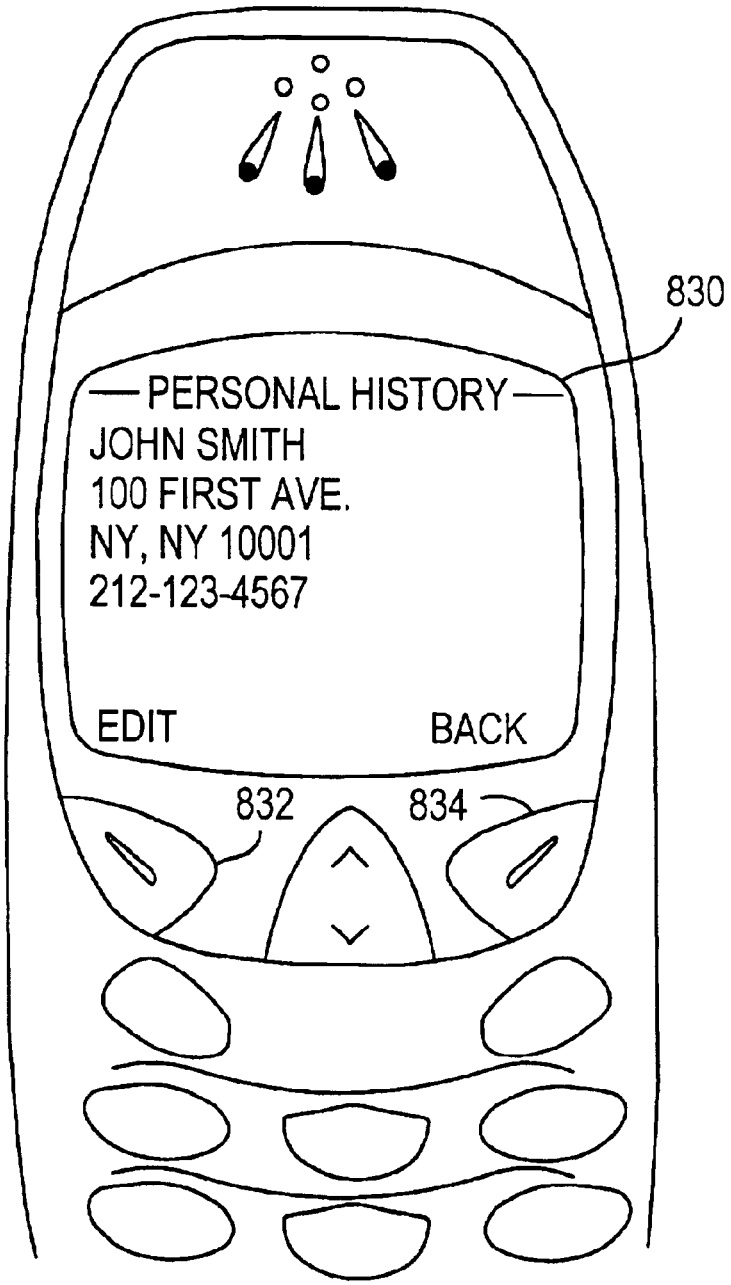

FIG. 26 illustrates display screen 830 when a wagerer has correctly entered in the pin and selected personal history option from player information menu 820 (FIG. 25). Similar to personal history display 720 (FIG. 17) shown on set-top box 14 and/or computer 16, the two-way data enabled cellular telephone display may show the wagerer's name, address, and telephone number. The wagerer may then have the option of changing the personal information by pressing "Edit" button 832 or to return to the previous screen by pressing "Back" button 834.

Figure 27:
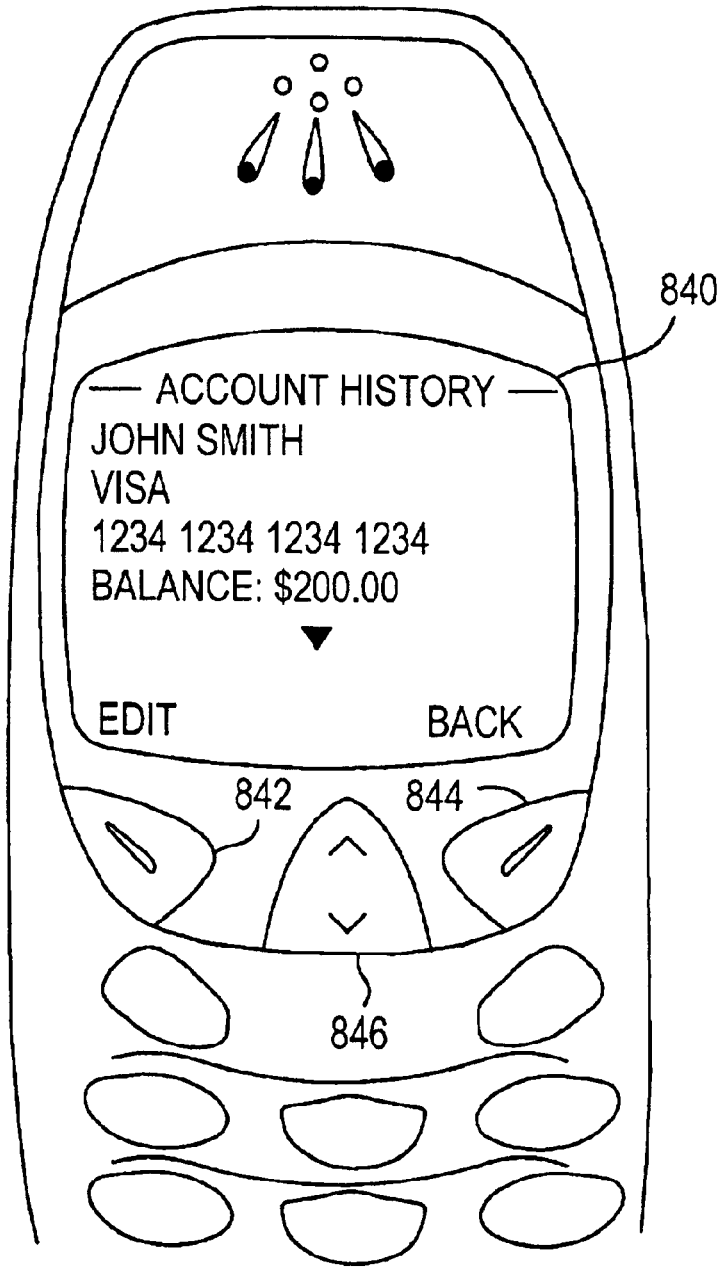
Figure 28:
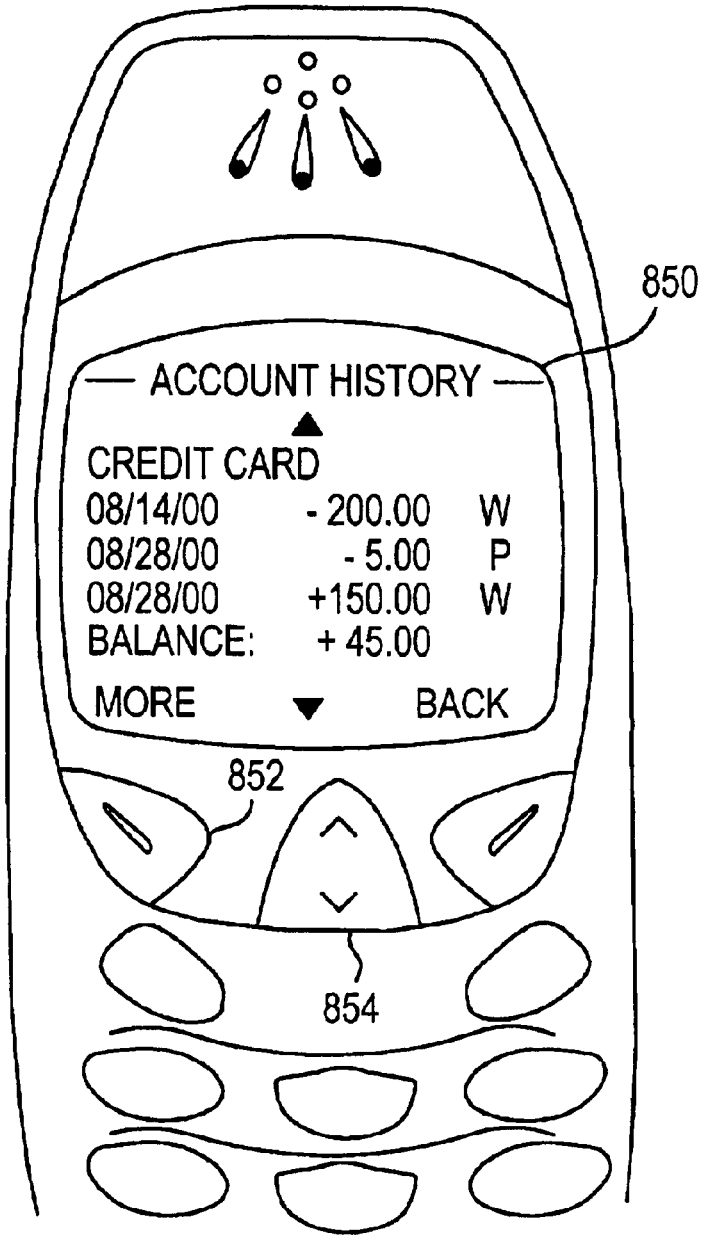

FIGS. 27–28 illustrate display screens 840 and 850 when a wagerer has correctly entered in the pin and selected account history option from player information menu 820 (FIG. 25). Similar to the account history display 730 (FIG. 18) shown on set-top box 14 and/or computer 16, the two-way data enabled cellular telephone may show the wagerer's name, account number, current balance, and a listing of credit history. The wagerer may press scroll button 846 or 854, or "More" button 852 to access additional credit history. The credit history may include a date of wager, amount charged or credited to the credit card, and type of transaction (e.g., W (Wager), P (Picks)). The wagerer may also have the option of changing the credit card information by pressing "Edit" button 842 or to return to the previous screen by pressing "Back" button 844.

Figure 29:
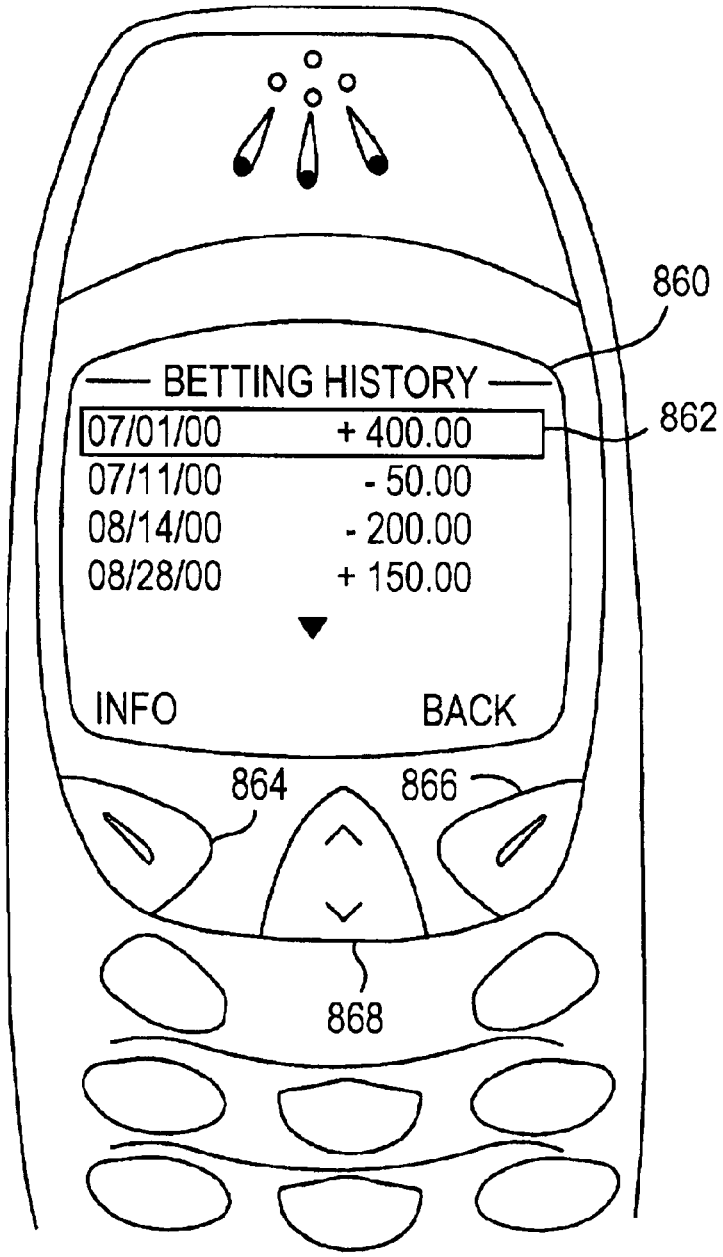

FIG. 29 illustrates display screen 860 when a wagerer has correctly entered in the pin and selected betting history option from player information menu 820 (FIG. 25). Similar to the betting history display 750 (FIG. 19) shown on set-top box 14 and/or computer 16, the two-way data enabled cellular telephone may show the wagerer's betting history up to a certain date. Display screen 860 may show the wagering date and the net gain or loss on that day. The wagerer may move a highlighted bar or outlined box 862 up and down using arrow buttons 868. Once the desire date is selected, the wagerer may press "INFO" button 864 to view details of the selected wager. The wagerer may also press "BACK" button 866 to return to the previous screen.

Figure 30:
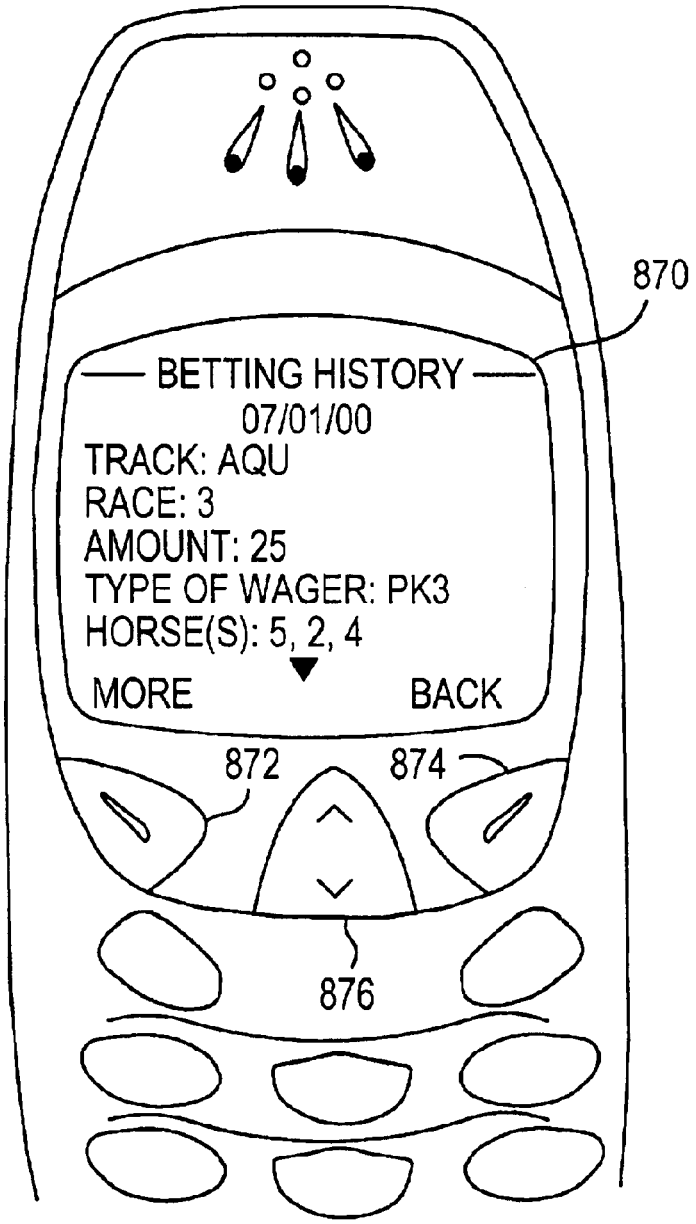
Figure 31:
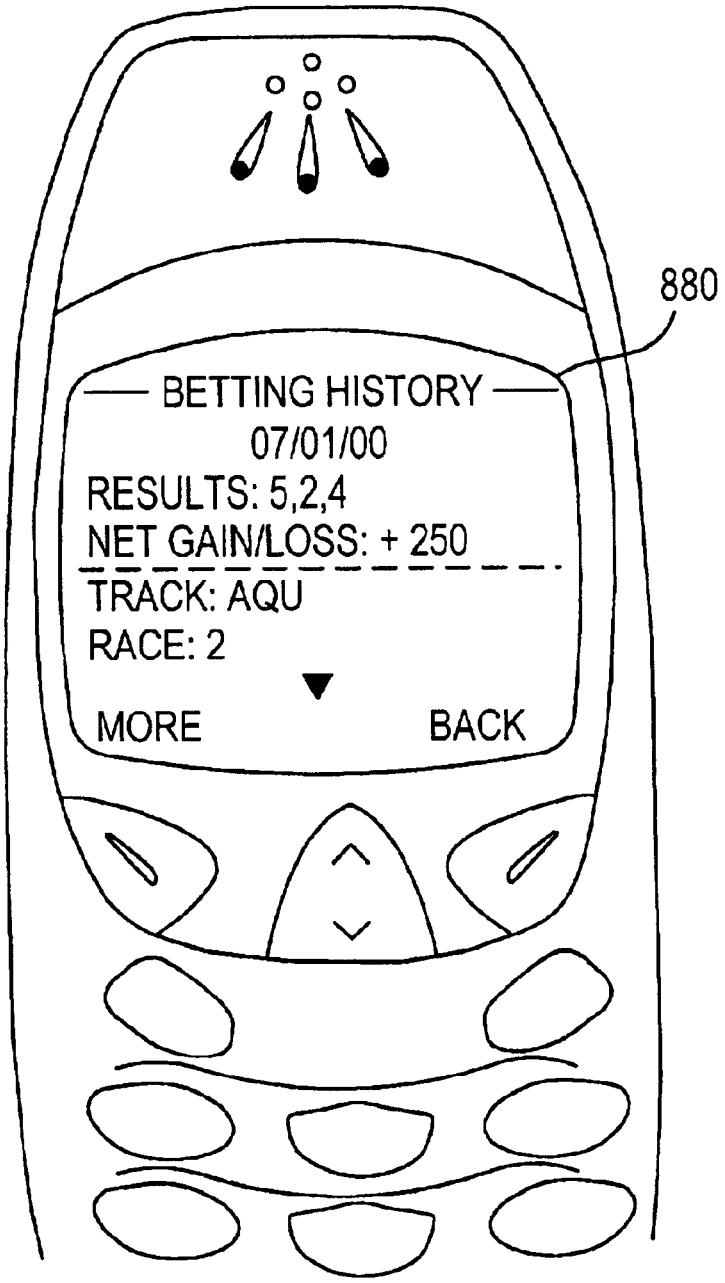

FIGS. 30–31 illustrate display screens 870 and 880 when a wagerer presses "INFO" button 864 to view more information about the selected date "7/01/00." The display may include track, race, amount, type of wager, horse(s), results, and wins or losses for each wager on the selected day. In order to view the information, the wagerer may use scroll button 876 or "More" button 872 to view the next page of information. The wagerer may also press "Back" button 874 to return to the previous screen.

Figure 32:
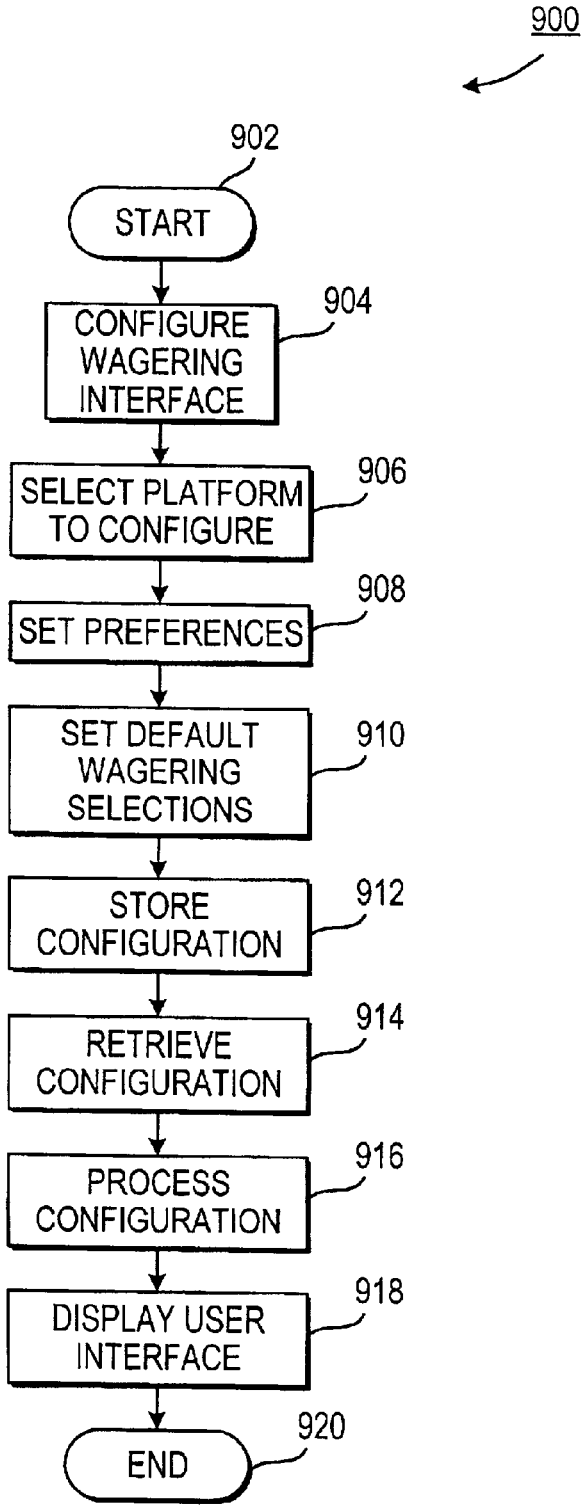
FIG. 32 is a flow diagram illustrating the cross-platform access to a wagering interface in accordance with the present invention.

FIG. 32 illustrates a flow diagram of the cross-platform access to a wagering interface in accordance with the present invention. Process 900 begins at step 902. At step 904, a wagerer can configure the wagering interface from a first wagering platform. This may involve steps 906, 908, and 910, in which the wagerer may select the platform to configure, set the preferences for a particular platform, and set default wagering selections, respectively. The wagerer may select the same configurations for all the selected platforms or may customize each platform. At step 912, the configurations can be stored in a storage unit such as a database. There may be one or more databases, which may be located in a wagering data hub, a subscriber management system, or the first wagering platform. At step 914, a second wagering platform (which may be the first wagering platform or a different wagering platform) may retrieve the configuration from the storage unit. The configuration may be processed at step 916 so that the user interface may be suitable for display on the second wagering platform. The user interface may then be displayed on the second wagering platform at step 918 and the process ends at step 920.

Thus it is seen that a consistent wagering interface is provided that enables a wagerer to access a variety of platforms. One skilled in the art will appreciate that the present invention can be practiced by other than the described embodiments, which are presented for purposes of illustration and not of limitation, and the present invention is limited only by the claims which follow.

What is claimed is:

1. A method for providing wagering interfaces comprising:

providing a first type of wagering platform and a second type of wagering platform, wherein the first type of wagering platform and the second type of wagering platform are selected from the group consisting of a television platform, a computer platform, and a telephone platform, and wherein the second type of wagering platform is different than the first type of wagering platform;

configuring a first wagering interface on the first type of wagering platform for use by a wagerer;

storing a configuration of the first wagering interface; and displaying a second wagering interface on the second type of wagering platform for use by the wagerer, wherein the second wagering interface is consistent with the configuration of the first wagering interface.

2. The method of claim 1 wherein configuring the first wagering interface comprises selecting a wagering preference.

3. The method of claim 2 wherein selecting the wagering preference comprises selecting a wagering sport.

4. The method of claim 2 wherein selecting the wagering preference further comprises selecting a player type, wherein the player type is one of beginner, intermediate, or advanced wagerer.

5. The method of claim 2 wherein selecting the wagering preference further comprises selecting and ordering menu options for display in the first wagering interface.

6. The method of claim 2 wherein selecting the wagering preference further comprises selecting the wagering preference for the second wagering interface.

7. The method of claim 2 wherein selecting the wagering preference further comprises selecting a different wagering preference for the second wagering interface.

8. The method of claim 1 wherein configuring the first wagering interface comprises selecting a default wagering selection.

9. The method of claim 1 wherein storing the configuration comprises storing a preference and a default wagering selection in a database.

10. The method of claim 9 comprising providing the database in a wagering data hub.

11. The method of claim 9 comprising providing the database in a subscriber management system.

12. The method of claim 9 comprising providing the database in the first type of wagering platform.

13. The method of claim 1 wherein storing the configuration comprises storing a preference and a default wagering selection in multiple databases.

14. The method of claim 1 wherein displaying the second wagering interface comprises retrieving the configuration from the first type of wagering platform.

15. The method of claim 14 further comprising processing the configuration so that the second wagering interface is suitable for display on the second type of wagering platform.

16. A system for providing a wagering interface comprising:

a first type of wagering platform that configures a first wagering interface for use by a wagerer;

a storage unit containing a configuration from the first wagering interface; and a second type of wagering platform that displays a second wagering interface for use by the wagerer, wherein the second wagering interface is consistent with the configuration of the first wagering interface, wherein the first type of wagering platform and the second type of wagering platform are selected from the group consisting of a television platform, a computer platform and a telephone platform, and wherein the second type of wagering platform is different than the first type of wagering platform.

17. The system of claim 16 wherein the first type of wagering platform the television platform.

18. The system of claim 16 wherein the first type of wagering platform is the computer platform.

19. The system of claim 16 wherein the first type of wagering platform is the telephone platform.

20. The system of claim 16 wherein the first wagering interface comprises a wagering preference selected by a wagerer.

21. The system of claim 16 wherein the first wagering interface comprises a default wagering selection selected by a wagerer.

22. The system of claim 16 wherein the storage unit comprises a database.

23. The system of claim 22 wherein the database is located in a wagering data hub.

24. The system of claim 22 wherein the database is located in a subscriber management system.

25. The system of claim 22 wherein the database is located in the first type of wagering platform.

26. The system of claim 16 wherein the storage unit comprises multiple databases.

27. The system of claim 16 wherein the second type of wagering platform is the television platform.

28. The system of claim 16 wherein the second type of wagering platform is the computer platform.

29. The system of claim 16 wherein the second type of wagering platform is the telephone platform.

30. The system of claim 16 wherein the second wagering interface comprises a wagering preference selected by a wagerer from the storage unit.

31. The system of claim 16 wherein the second wagering interface comprises a default wagering selection from the storage unit.

32. A machine-readable medium encoded with machine-readable instructions for use in a system that provides wagering interfaces, the machine-readable instructions configured to:

provide a first type of wagering platform and a second type of wagering platform, wherein the first type of wagering platform and the second type of wagering platform are selected from the group consisting of a television platform, a computer platform, and a telephone platform, and wherein the second type of wagering platform is different than the first type of wagering platform;

configure a first wagering interface on the first type of wagering platform for use by a wagerer;

store a configuration of the first wagering interface; and display a second wagering interface on the second type of wagering platform for use by the wagerer, wherein the second wagering interface is consistent with the configuration of the first wagering interface.

33. The machine-readable medium of claim 32, wherein the machine-readable instructions configured to provide the first wagering interface is further configured to receive a selection of a wagering preference.

34. The machine-readable medium of claim 33, wherein the machine-readable instructions are further configured to receive a selection of a wagering sport.

35. The machine-readable medium of claim 33, wherein the machine-readable instructions are further configured to receive a selection of a player type, wherein the player type is one of beginner, intermediate, or advanced wagerer.

36. The machine-readable medium of claim 33, wherein the machine-readable instructions are further configured to receive a selection and order of menu options for display in the first wagering interface.

37. The machine-readable medium of claim 33, wherein the machine-readable instructions are further configured to receive a selection of the wagering preference for the second wagering interface.

38. The machine-readable medium of claim 33, wherein the machine-readable instructions are further configured to receive a selection of a different wagering preference for the second wagering interface.

39. The machine-readable medium of claim 32 wherein the machine-readable instructions are further configured to provide a default wagering selection.

40. The machine-readable medium of claim 32 wherein the machine-readable instructions are further configured to store a preference and a default wagering selection in a database.

41. The machine-readable medium of claim 40 wherein the database is provided in a wagering data hub.

42. The machine-readable medium of claim 40 wherein the database is provided in a subscriber management system.

43. The machine-readable medium of claim 40 wherein the database is provided in the first type of wagering platform.

44. The machine-readable medium of claim 32 wherein the machine-readable instructions are further configured to store a preference and a default wagering selection in multiple databases.

45. The machine-readable medium of claim 32 wherein the machine-readable instructions configured to display the second wagering interface are further configured to retrieve the configuration from the first type of wagering platform.

46. The machine-readable medium of claim 45 wherein the machine-readable instructions are further configured to process the configuration so that the second wagering interface is suitable for display on the second type of wagering platform.

* * * * *

UNITED STATES PATENT AND TRADEMARK OFFICE

CERTIFICATE OF CORRECTION

PATENT NO. : 6,837,789 B2
DATED : January 4, 2005
INVENTOR(S) : Garahi et al.

It is certified that error appears in the above-identified patent and that said Letters Patent is hereby corrected as shown below:

Title page,
Item [56], References Cited, U.S. PATENT DOCUMENTS, insert
-- 5,823,877 A 10/1998 Scagnelli et al. 463/41 --.

Column 7,
Line 8, “show” should read -- shown --.

Column 13,
Line 25, “can displayed” should read -- can be displayed --.

Signed and Sealed this

Twenty-third Day of August, 2005

JON W. DUDAS
*Director of the United States Patent and Trademark Office*